US007451603B2

(12) United States Patent
Tuszkiewicz et al.

(10) Patent No.: US 7,451,603 B2
(45) Date of Patent: Nov. 18, 2008

(54) PORTABLE COOLED MERCHANDIZING UNIT

(75) Inventors: George A. Tuszkiewicz, Plymouth, MN (US); Galen Hersey, Minneapolis, MN (US); Thomas Meehan, Edina, MN (US); Mark Bedard, Greenfield Park (CA)

(73) Assignee: General Mills, Inc., Minneapolis, MN (US)

( * ) Notice: Subject to any disclaimer, the term of this patent is extended or adjusted under 35 U.S.C. 154(b) by 55 days.

(21) Appl. No.: 11/086,769

(22) Filed: Mar. 22, 2005

(65) Prior Publication Data

US 2005/0210884 A1 Sep. 29, 2005

Related U.S. Application Data

(60) Provisional application No. 60/621,528, filed on Oct. 22, 2004.

(51) Int. Cl.
*F25B 21/02* (2006.01)

(52) U.S. Cl. ..... 62/3.6; 62/291; 62/457.9

(58) Field of Classification Search ..... 62/3.2, 62/3.3, 3.7, 3.62, 234, 264, 457.1, 457.6, 62/457.9, 458, 405, 150, 285, 261, 291; 165/255, 165/DIG. 192, DIG. 195, DIG. 212
See application file for complete search history.

(56) References Cited

U.S. PATENT DOCUMENTS 3,283,520 A * 11/1966 Donohue et al. ..... 62/3.61
3,315,474 A 4/1967 Farer
3,399,546 A 9/1968 Kuns et al.
3,733,836 A * 5/1973 Corini ..... 62/3.61
4,326,383 A 4/1982 Reed et al.
4,537,034 A * 8/1985 Crouch ..... 62/62
4,726,193 A 2/1988 Burke et al.
D299,391 S 1/1989 Meehan
4,882,910 A 11/1989 Meehan et al.
D307,026 S 4/1990 Barish
4,946,032 A 8/1990 Stoddard et al.
5,357,767 A * 10/1994 Roberts ..... 62/256
5,522,216 A 6/1996 Park et al.
5,561,981 A * 10/1996 Quisenberry et al. ..... 62/3.7
5,718,124 A * 2/1998 Senecal ..... 62/457.6
D396,048 S 7/1998 Meehan (Continued)

FOREIGN PATENT DOCUMENTS

EP 0 572 267 B1 7/1996

(Continued)

*Primary Examiner*—Mohammad M Ali
(74) *Attorney, Agent, or Firm*—Timothy A. Czaja; Annette M. Frawley; Douglas J. Taylor

(57) ABSTRACT

A portable cooled merchandising unit including a product container assembly and a thermoelectric assembly. The product container assembly includes an interior floor and at least one interior panel extending from the floor and defining a portion of an interior region. An opening to the interior region is defined opposite the floor. A first airflow path is defined along at least a portion of the panel and fluidly connected to the opening. The thermoelectric assembly includes a thermoelectric device connected to a heat sink that is fluidly connected to the airflow path away from the opening. Further, a fan is positioned to circulate air from the thermoelectric device, through the airflow path, and to the opening.

16 Claims, 13 Drawing Sheets

U.S. PATENT DOCUMENTS

| | | | | | |
|---|---|---|---|---|---|
| 5,782,094 | A * | 7/1998 | Freeman | 62/3.6 |
| 6,003,318 | A * | 12/1999 | Busick et al. | 62/3.64 |
| 6,205,790 | B1 * | 3/2001 | Denkin et al. | 62/3.7 |
| 6,298,673 | B1 | 10/2001 | Fung et al. | |
| 6,351,964 | B1 * | 3/2002 | Brancheau et al. | 62/249 |
| 6,401,399 | B1 | 6/2002 | Roche et al. | |
| 6,460,372 | B1 | 10/2002 | Fung et al. | |
| 6,463,743 | B1 * | 10/2002 | Laliberte | 62/3.3 |
| 6,550,255 | B2 * | 4/2003 | Rudick et al. | 62/6 |
| 6,658,858 | B1 * | 12/2003 | Thompson et al. | 62/3.6 |
| 6,701,736 | B1 | 3/2004 | Johnson | |
| 6,976,371 | B2 * | 12/2005 | Gleason et al. | 62/457.9 |
| 7,107,779 | B2 * | 9/2006 | Avenwedde et al. | 62/264 |
| 7,152,412 | B2 * | 12/2006 | Harvie | 62/3.5 |
| 2001/0042383 | A1 | 11/2001 | Chiang | |
| 2001/0042384 | A1 | 11/2001 | Chiang | |
| 2002/0121096 | A1 | 9/2002 | Harrison et al. | |
| 2003/0115902 | A1 | 6/2003 | Busick et al. | |
| 2004/0194496 | A1 * | 10/2004 | Gleason et al. | 62/457.9 |

FOREIGN PATENT DOCUMENTS

| | | | |
|---|---|---|---|
| GB | 2 252 815 | A | 8/1992 |
| JP | 2002-22345 | A * | 1/2002 |
| SU | 1195152 | | 4/1984 |
| WO | 97/39296 | | 10/1997 |
| WO | 03/093738 | | 11/2003 |
| WO | 03/099703 | A2 | 12/2003 |

* cited by examiner

PORTABLE COOLED MERCHANDIZING UNIT

CROSS-REFERENCE TO RELATED APPLICATIONS

This application claims the benefit of, and incorporates herein by reference an entirety of, U.S. Provisional Application Ser. No. 60/621,528 filed Oct. 22, 2004.

BACKGROUND

The present invention relates to a cooled merchandizing unit. More particularly, the present invention relates to a portable cooled (e.g., refrigeration and/or freezer) merchandizing unit having a thermoelectric assembly and means for circulating air from the thermoelectric assembly through a product container.

Perishable food items are frequently displayed and sold in grocery stores. Some perishable food items are maintained in inventory year-round and are often placed in a permanent merchandizing unit. Other perishable food items are offered during promotions, and are better suited to temporary cooling displays. Some temporary cooling displays are disposable cases employing ice packs and ice to cool the perishable items, and grocers, due to the limited cooling capacity, disfavor these disposable units. Another disincentive to the use of disposable cooling units is the cost associated with their disposal. To this end, grocers have a need for temporary cooling displays that are effective in safely cooling perishable food items. Similar needs arise for temporary cooling displays of frozen food items.

Conventional refrigerators and freezers employed as temporary cooling displays are disfavored due primarily to their expense and non-steady cooling temperatures. As a point of reference, conventional refrigerators and freezers generally include an insulated enclosure having a centralized cooling system employing a vapor compression cycle refrigerant. The cooling system is usually characterized as having a greater cooling capacity than the actual heat load, and this results in the cooling system acting intermittently in a binary duty cycle. That is to say, the cooling system is either on or off. The binary duty cycle is associated with temperature variations inside the insulated the enclosure. For example, when the compressor is off, the temperature in the enclosure increases until reaching an upper limit where the compressor is cycled on. Conversely, when the compressor is on, the temperature in the enclosure decreases until reaching a lower limit where the compressor is cycled off. Thus, the temperature in a conventional refrigerator or freezer is not steady, but cycles between pre-selected upper and lower limits.

In addition, vapor compression cooling systems frequently employ fluorinated hydrocarbons (for example, Freon®) as the refrigerant. The deleterious effects of fluorinated hydrocarbons on the environment are well known, and both national and international regulations are in effect to limit the use of such fluorinated hydrocarbons as refrigerants.

With the above in mind, cooling systems that employ thermoelectric devices for cooling are preferred over vapor pressure refrigerators. The use of thermoelectric devices operating on a direct current (DC) voltage system are known in the art and can be employed to maintain a desired temperature in refrigerators and portable coolers. One example of a cooled container employing a thermoelectric device is described in U.S. Pat. No. 4,726,193 titled "Temperature Controlled Picnic Box." The temperature controlled picnic box is described as having a housing with insulated walls forming a food compartment, an open top, and a lid for enclosing the food compartment. A thermoelectric device for cooling the picnic box is connected to the lid by fasteners. The thermoelectric device is limited in its capacity to cool the picnic box, and the enclosed food compartment is ill suited for temporary cooling displays.

Other thermoelectric devices used as refrigerators are known. One example is a refrigerator employing super insulation materials and having a thermoelectric cooling device disposed within a door, as described in U.S. Pat. No. 5,522,216 titled "Thermoelectric Refrigerator." The thermoelectric refrigerator described in U.S. Pat. No. 5,522,216 includes an airflow management system. The airflow management system establishes a desired airflow path across the cooling device to provide a cooled refrigerator unit. The cooling delivered by the thermoelectric device is not unlimited, and for this reason, expensive super insulation is positioned around the cabinet to minimize the cooling loss.

All coolers and refrigerators experience the formation of condensation. Condensation forms whenever warm, humid air from the environment interacts with cooled surfaces. For example, humidity in the air will condense on the cooling elements of the refrigerator or freezer and forms liquid condensate. The liquid condensate builds up within the refrigerator or freezer and can undesirably collect on the products that are being cooled. To this end, condensates in cooling systems can buildup and/or eventually drip on the cooled products.

Grocers and merchandisers have a need to display perishable and frozen food items during temporary displays such as promotional events. The known temporary cooling displays can be generally characterized as inefficient in the case of disposable cases, and expensive in the case of refrigerated or freezer cases. Therefore, a need exists for a portable cooled merchandizing unit that is efficient at cooling and inexpensive to operate.

SUMMARY

One aspect of the present invention is related to a portable cooled merchandizing unit. The portable cooled merchandizing unit includes a product container assembly and a thermoelectric assembly. The product container includes an interior floor for supporting product and at least one interior panel extending from the floor to define a portion of an interior region. In addition, the product container assembly defines an opening to the interior region opposite the floor and a first airflow path along at least a portion of the panel and fluidly connected to the opening. The thermoelectric assembly includes a thermoelectric device, a heat sink, and a fan. The heat sink is coupled to the thermoelectric device and is fluidly connected to the airflow path away from the opening. Finally, the fan is positioned to direct air from the heat sink through the airflow path, and to the opening.

Another aspect of the present invention is related to a method of cooling products on display. The method includes providing a merchandising unit including an interior container having a floor and a panel combining to form a portion of an interior region. The merchandising unit forms an airflow path along at least a portion of an exterior of the panel to an opening opposite the floor. A heat sink of a thermoelectric assembly is fluidly connected to the airflow path. The heat sink is further coupled to a thermoelectric device. Products are placed in the interior region. The method further includes operating a fan to circulate cooling air along the airflow path and over products in the interior region.

BRIEF DESCRIPTION OF THE DRAWINGS

Embodiments of the invention are better understood with reference to the following drawings. The elements of the drawings are not necessarily to scale relative to each other. Like reference numerals designate corresponding similar parts.

DETAILED DESCRIPTION

Figure 1:
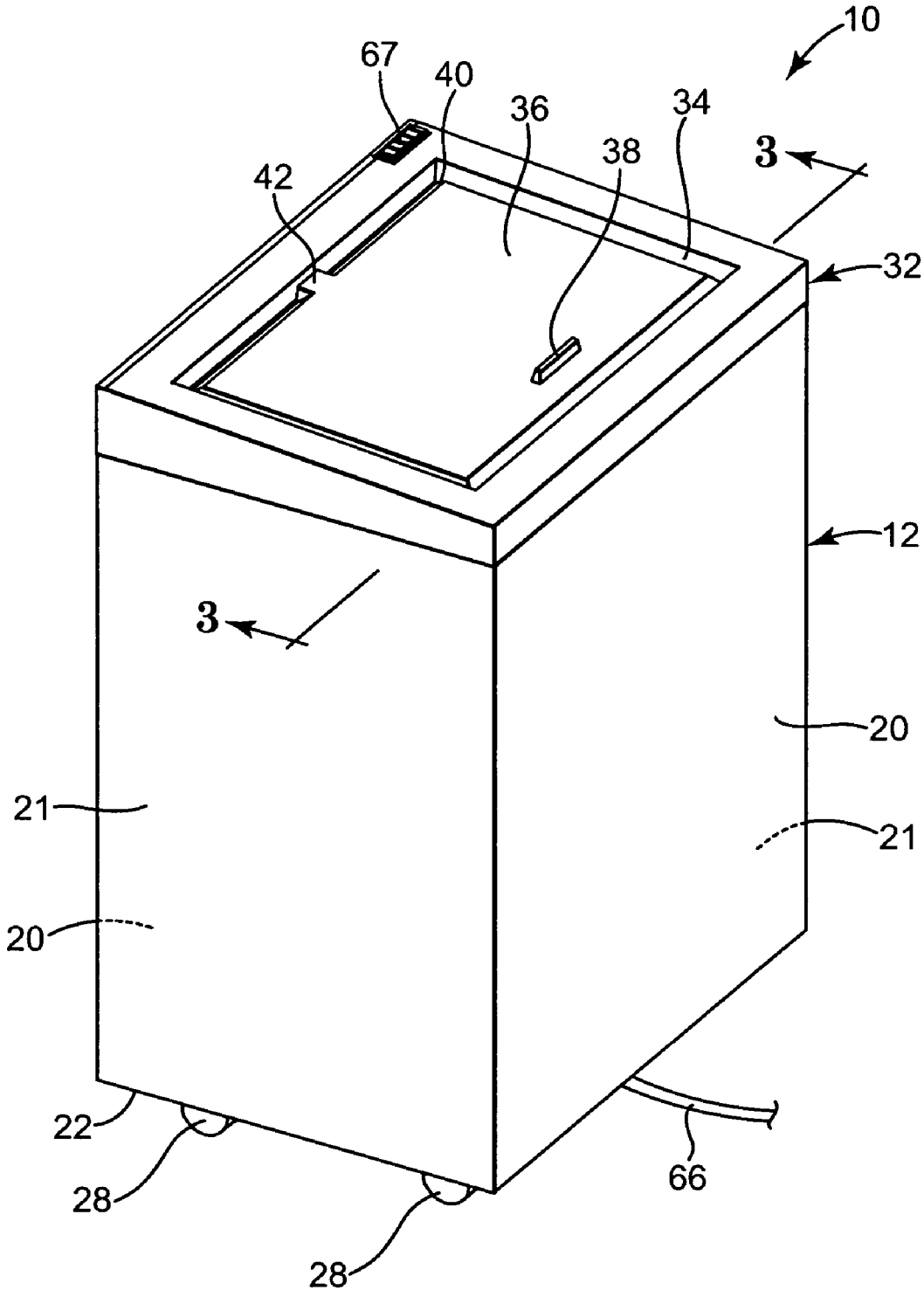
FIG. 1 is a perspective view of a portable cooled merchandizing unit according to one embodiment of the present invention.
Figure 2:
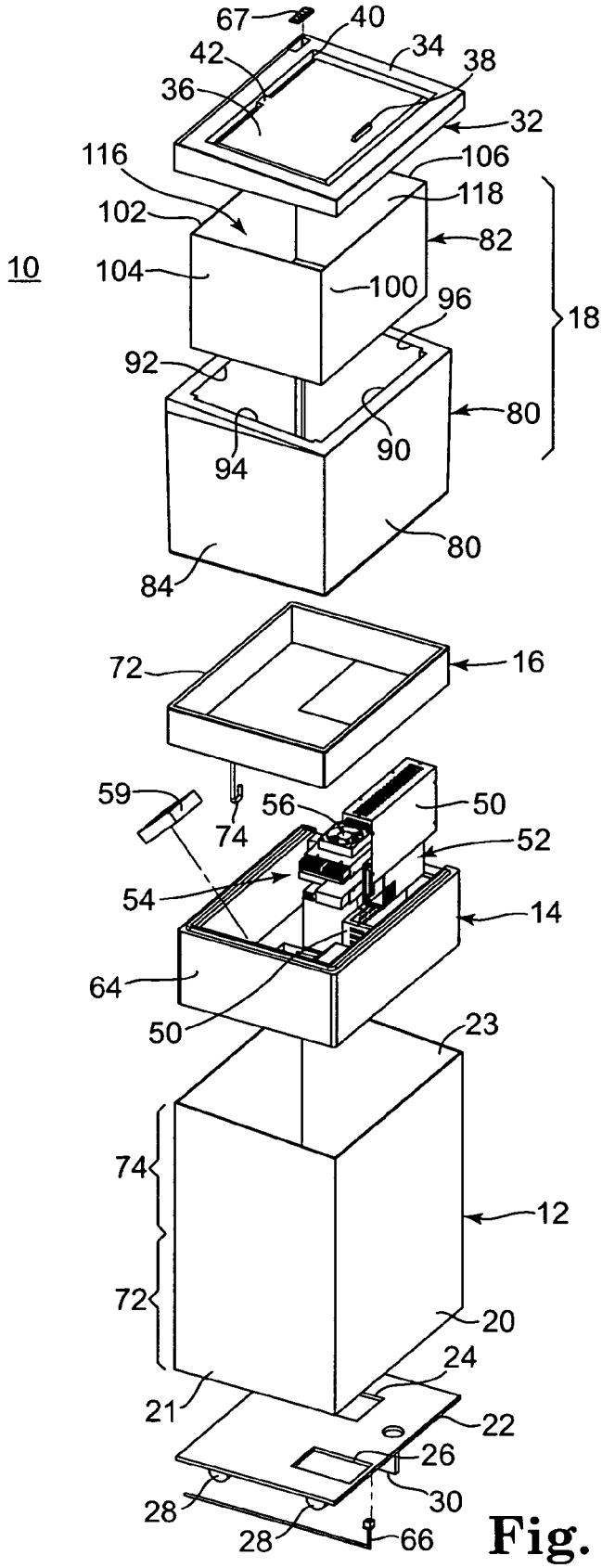
FIG. 2 is an exploded view of a portable cooled merchandising unit according to one embodiment of the present invention.

A portable cooled merchandizing unit 10 according to one embodiment of the present invention is illustrated in FIGS. 1 and 2. As used throughout the specification, the term "cooled" is in reference to temperatures below normal room temperature, and includes temperature ranges both above freezing (e.g., 32° F.-50° F.; akin to a refrigerator) and at or below freezer (e.g., 0° F.-32° F.; akin to a freezer). FIG. 1 illustrates the merchandizing unit 10 in an assembled state, and FIG. 2 illustrates an exploded, perspective view of the merchandizing unit 10. With this in mind, the portable cooled merchandizing unit 10 generally includes a housing 12, a thermoelectric assembly 14, a transition assembly 16, and a product container assembly 18. Details on the various components are provided below. In general terms, however, the housing 12 surrounds the thermoelectric assembly 14, the transition assembly 16, and the product container assembly 18. The transition assembly 16 provides a fluid interface between the thermoelectric assembly 14 and the product container assembly 18, facilitating cooling of product (not shown) contained by the product container assembly 18 via the operation of the thermoelectric assembly 14.

The housing 12 includes opposing faces 20 and opposing sides 21 that are attached to and extend upwardly from a bottom plate 22. In the perspective view of FIG. 1, one of the faces 20 is visible as is one of the sides 21, the opposing respective face and side being blocked from view in the depiction of FIG. 1. The faces 20 and sides 21 combine to define an open top 23 (best shown in FIG. 2) opposite the bottom plate 22. While the housing 12 is depicted in the Figures as having a rectangular or square shape, other configurations can also be employed. For example, the housing 12 can have a shape suggestive of product (not shown) contained by the merchandizing unit 10 (e.g., a vercon shape commonly associated with Yoplait® yogurt containers, etc.).

In a further embodiment, a graphic or display (not shown) is applied to or formed by an exterior of the housing 12. For example, in one embodiment, a wrappable graphic system (not shown) is applied over the housing 12. The wrappable graphic system can be made out of paperboard or other printable material that allows for graphics of the unit 10 to be changed without altering more generic graphics permanently applied to/formed by an exterior of the housing 12. The wrappable graphic system is preferably foldable or wrappable about the housing 12, such as providing an enlarged, flexible panel having a connecting device (e.g., a zipper) at opposing ends thereof to facilitate easy removal. The wrappable graphic system can be adapted for more rigid securement to the housing 12 by including scored flaps that fold under the bottom plate 22. In one embodiment, flaps are held in place relative to the housing 12/bottom plate 22 by semi-permanent tape. With this construction, the flaps can be easily lifted along the semi-permanent tape. By positioning the semi-permanent tape at or along the bottom plate 22, the tape will be in a horizontal plane (relative to an upright orientation of the unit 10) and thus is not in a shear mode for more effectively holding the wrappable graphic system panel, and does not contact sides of the housing 12 in a manner that might otherwise damage the housing 12 sides when removing the wrappable graphic system. Conversely, in one embodiment, a top of the wrappable graphic system is frictionally held between the housing 12 and a door assembly described below.

The bottom plate 22 defines, in one embodiment, a first opening 24 and a second opening 26, the openings 24, 26 providing air access and egress for the unit 10. Specifically, in one embodiment the first opening 24 is an air inlet and the second opening 26 is an air outlet. The openings 24, 26 are depicted as rectangular holes, although other shapes and sizes for the openings 24, 26 are equally acceptable.

Wheels or casters 28 are, in one embodiment, connected to the housing bottom plate 22 to facilitate moving of the merchandizing unit 10, for example when positioning the merchandizing unit 10 for display in a grocery store. In one embodiment, four wheels 28 are connected to the bottom plate 22, although only two of the wheels 28 are visible in the illustrations of FIGS. 1 and 2. In a preferred embodiment, the wheels 28 are tucked under the housing 12 such that the wheels 22 are safely positioned away from foot traffic and permit multiple merchandizing units 10 to be aligned side-by-side. Alternatively, components other than wheels/casters can be employed to raise the bottom plate 22 relative to a floor.

Figure 3:
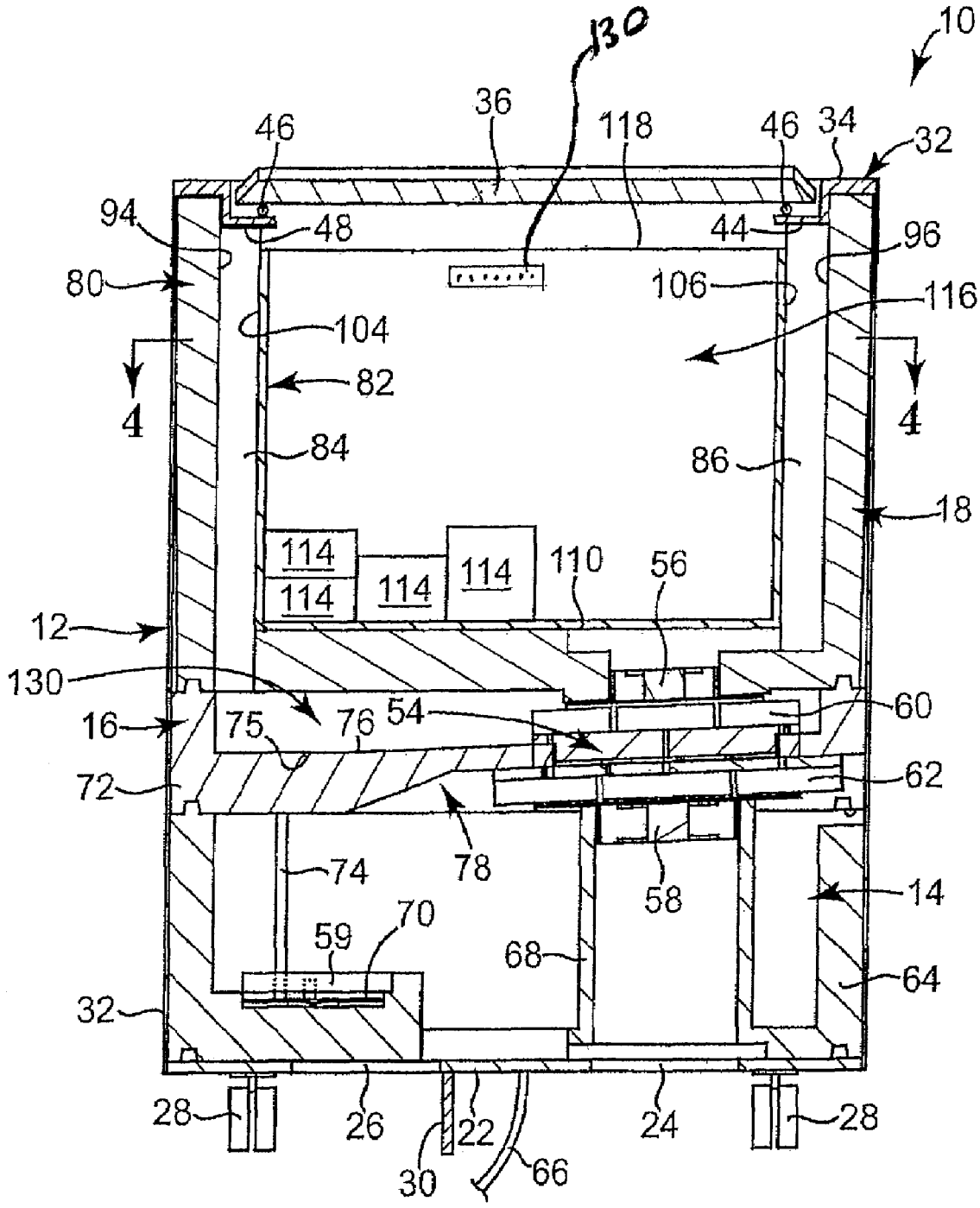
FIG. 3 is a front cross-sectional view of the portable cooled merchandizing unit of FIG. 2 as assembled.

In one embodiment, an air baffle 30 is secured to the bottom plate 22 as best shown in FIG. 3. The air baffle 30 is positioned between the first and second openings 24, 26 and extends below the bottom plate 22 (relative to an upright orientation of the merchandizing unit 10) a distance at least approximating a height of the wheels 28 (or any other component that raises the bottom plate 22 relative to a floor on which the merchandizing unit 10 is located). In one embodiment, the air baffle 30 is semi-flexible or rigid with a predetermined shape (e.g., a plastic material having an appropriate thickness to impart desired flexibility, or similar material) and extends slightly beyond a height of the wheels 28 (thus contacting/dragging along the floor on which the merchandising unit 10 is located). Regardless, the air baffle 30 serves to isolate airflow between the first and second openings 24, 26, and thus incoming and outgoing airflow relative to the merchandising unit 10, as described below. With this in mind, the air baffle 30 can assume a wide variety of forms and can be connected to the bottom plate 22 in any conventional fashion (e.g., mechanical fasteners such as staples, screws, adhesive, etc.). In an alternative embodiment, the air baffle 30 can be eliminated.

In one embodiment, the merchandizing unit 10 further includes a door assembly 32, apart from the housing 12, that includes a sash or flange 34 and a door 36. The door 36 is hingedly attached to the sash 34 such that the door 36 can open and close relative to the product container assembly 18 upon final assembly. For example, in one embodiment, the door 36 includes a handle 38 positioned opposite a hinge point 40 (referenced generally) at which the door 36 is pivotally attached to the sash 34. Upon final assembly, the door 36 is inclined downwardly (i.e., the handle 38 is "below" the hinge point 40), such that the door 36 naturally assumes a closed position via gravity. For example, the product container assembly 18, to which the sash 34 is assembled, can define the downward inclination of the door 36. In one embodiment, to ensure that the door 36 is not opened beyond a perpendicular orientation relative to the sash 34 (that might otherwise cause the door 36 to undesirably remain open after a consumer has accessed an interior of the unit 10), the door 36 defines a stop 42 adjacent the hinge point 40. The stop 42 projects from a plane of the door 36 and contacts the sash 34 (with rotation of the door 36 relative to the sash 34) prior to the door 36 moving to or beyond a perpendicular orientation. In alternative embodiments, the stop 42 can be formed on the sash 34 or simply eliminated. Alternatively, other constructions permitting movement of the door 36 are equally acceptable. In one embodiment, the door 36 is a two-ply construction consisting of two, separated sheets of plastic, preferably clear plastic. This one preferred construction provides an increased insulation factor (as opposed to a single sheet), while allowing a consumer to view an interior of the product container assembly 18. Alternatively, the door 36 can assume a variety of other forms, such as a single sheet of opaque material.

Regardless, in one embodiment, the door assembly 32 is removably coupled to the top 23 of the housing 12 and/or the product container assembly 18 such that the door assembly 32 can be entirely disassembled from the housing 12 and/or the product container assembly 18 when desired. As described in greater detail below, this one embodiment construction facilitates entire replacement and/or replenishing of goods (not shown) within the product container assembly 18, including replacement of a portion of the product container assembly 18. In one embodiment, push pins (not shown) or similar components are employed to secure the door assembly 32 to the housing 12/product container assembly 18 in a manner that makes it difficult for a consumer to easily remove the door assembly 32. Alternatively, the door assembly 32 can be even more permanently affixed to the housing 12 and/or the product container assembly 18.

With additional reference to FIG. 3, in one embodiment, the sash 34 forms a flange 44 for supporting the door 36 in a closed position. A gasket 46 is provided, in one embodiment, between a perimeter of the door 36/flange 44 interface to minimize condensation along the door 36 due to environmental air. Further, and in another embodiment, an insulating body 48 (such as a thin foam or tape) is applied along an interior surface of a portion of the flange 48. In particular, the insulating body 48 is located along an area of the door assembly 32 otherwise in direct contact with forced, cooled air as described below. The insulating body 48 serves to reduce or eliminate condensation from forming as the cooled air is forced toward the door assembly 32. Alternatively, the insulating body 48 can be a deflector body or other structure that routes forced, cooled air away from the door 36 to again avoid condensation from forming on the door 36. For example, in a more preferred embodiment described below, the product container assembly 18 is configured to provide a deflector body. Alternatively, one or both of the gasket 46 and/or insulating body 48 can be eliminated.

With reference to FIGS. 2 and 3, the thermoelectric assembly 14 includes, in one embodiment, electrical boxes 50, a power control unit 52, a thermoelectric device 54, a first fan 56, a second fan 58 (shown in FIG. 3), a third fan 59 (represented schematically in FIG. 3 for ease of illustration), a cold sink 60, a hot sink 62, and a frame 64 encircling the components 50-62. As described in greater detail below, the thermoelectric device 54 operates, via the power control unit 52, to cool the cold sink 60. The first fan 56 directs airflow over the cold sink 60, the second fan 58 directs airflow over the hot sink 62, and the third fan 59 creates a positive airflow to direct airflow over collected condensate and exhausts air from the unit 10.

The electrical boxes 50 encompass the power control unit 52 that is in turn electrically connected to a power cord 66 of the thermoelectric assembly 14. In this regard, the power cord 66 supplies alternating current (AC) power to the control unit 52, and the control unit 52 converts the AC power to direct current (DC) power. To this end, and in one embodiment, the control unit 52 is adapted to meter the DC power to the thermoelectric device 54 such that the thermoelectric device 54 has a sufficient flow of DC power even in low-use (i.e., "sleep") modes. The control unit 52 regulates DC power flow to the thermoelectric device 54 to optimally power the device 54 during high peak usage, and the control unit 52 also ensures that some DC power is delivered to the thermoelectric device 54 during low use, or sleep, periods such that the thermoelectric device 54 is coolingly maintained in an "on" state.

In one embodiment, the control unit 52 utilizes a pulse width modulation control sequence to achieve optimal temperature control. In particular, the control unit 52 includes, or is connected to, a temperature sensor (not shown) located to sense temperatures at or in the product container assembly 18. When the sensed temperature at the product container assembly 18 is determined to be decreasing, the control unit 52 modulates power delivered to the thermoelectric device 54 by pulsing the delivered power in a linear fashion to decrease cooling provided by the thermoelectric device 54. With larger sensed temperature drops, the delivered power is pulsed more frequently (such that cooling provided by the thermoelectric device 54 decreases) more rapidly. Conversely, where the sensed temperature at the product container assembly 18 is determined to be increasing or rising, the control unit 52 operates to provide a more steady power supply (i.e., decrease in the frequency of pulsed off power), thereby providing more power to the thermoelectric device 54 (and thus increasing cooling provided by the thermoelectric device 54). The determination of whether temperature at the product container assembly 18 is increasing or decreasing can be made with reference to a previously sensed temperature (e.g., when currently sensed temperature exceeds previously sensed temperature (taken at pre-determined intervals) by a pre-determined value, it is determined that the product container assembly 18 is "cooling", such that frequency of pulsed power is increased). Alternatively, the sensed temperature can be compared to a pre-determined value(s) or parameters. For example, the control unit 52 can be programmed to decrease pulsing when the sensed temperature exceeds 34° F., and increase pulsing when the sensed temperature drops below 30° F. Alternatively, other temperature differential parameters can be employed (e.g., when operating the unit 10 as a freezer). The control unit 52 can, in one embodiment, operate to perform other temperature control functions, such as a defrost cycle in which the control unit 52 discontinues the delivery of power to the thermoelectric device 54 for a predetermined time period at predetermined intervals (e.g., power to the thermoelectric device 54 is stopped for five minutes every twelve hours), allowing the product container assembly 18 to heat and thus melt any accumulated frozen condensate.

Alternatively, the control unit 52 can employ any other control sequence/operations for controlling power delivery to the thermoelectric device. Pointedly, in one alternative embodiment, the control unit 52 does not perform any power control sequence such that a continuous supply of power is delivered to the thermoelectric device 54. Further, the sensed temperature can be displayed to users, such as by a display 67 carried by the door assembly 32. Alternatively, the display 67 can be eliminated.

The thermoelectric device 54 utilizes DC power to cool the product container assembly 18 in the following manner. For example, in one embodiment, the thermoelectric device 54 includes two opposing ceramic wafers (not shown) having a series of P and N doped bismuth-telluride semiconductors layered between the ceramic wafers. The P-type semiconductor has a deficit of electrons and the N-type semiconductor has an excess of electrons. When the DC power is applied to the thermoelectric device 54, a temperature difference is created across the P and N-type semiconductors and electrons move from the P-type to the N-type semiconductor. In this manner, the electrons move to a higher energy state, as known in the art, thus absorbing thermal energy and forming a cold region (i.e., the cold sink 60). The electrons at the N-type semiconductor continue through the series of semiconductors to arrive at the P-type semiconductor, where the electrons drop to a lower energy state and release energy as heat to a hot region (i.e., the hot sink 64). The above-described flow of electrons driven through P and N-type semiconductors by DC power is known in the art as the Peltier Effect. Peltier Effect thermoelectric devices can be beneficially employed as cooling devices (or reversed to create a heating device). In any regard, suitable thermoelectric devices for implementing embodiments of the present invention are known and commercially available.

The thermoelectric device 54 is coupled to the cold sink 60 and the hot sink 62 of the thermoelectric assembly 14. The cold and hot sinks 60, 62 are made of an appropriate material, such as aluminum or copper, although other known heat sink materials are equally acceptable. To this end, reference to the sink 60 as a "cold" sink and the sink 62 as a "hot" sink reflects a temperature of the sink 60, 62 when the unit 10 operates in a cooling mode (i.e., the sink 60 is "cold" and the sink 62 is "hot"); however, it should be understood that both of the sinks 60, 62 are, and can be referred to as, "heat sinks". This explanation is reflective of the fact that the sink 60 is equally capable as serving as a "hot" sink and the sink 62 as a "cold" sink, such as, for example, when the unit 10 operates in a defrost mode, as described elsewhere.

The fans 56, 58, 59 are electrical fans having propellers adapted for moving air when rotated. The first fan 56 is electrically coupled to the power control unit 52 and is positioned to draw air from the product container assembly 18 across the cold sink 60 and direct cooled air back to the product container assembly 18, as described in detail below. The second fan 58 is electrically coupled to the power control unit 52 and is positioned to direct air across the hot sink 62. Finally, the third fan 59 is electrically coupled to the power control unit 52 and is positioned to direct airflow across collected condensate and exhaust air out of the merchandizing unit 10, as described in greater detail below. While the merchandizing unit 10 has been described as including three of the fans 56, 58, 59, any other number can alternatively be employed. For example, the unit 10 can include only a single fan that effectuates desired airflow relative to the thermoelectric device 54.

The frame 64 is, in one embodiment, an insulating frame and is formed of a lightweight, thermally insulting material. Suitable lightweight, insulating materials include, but are not limited to, rigid foamed polymers, open cell foams, closed cell foams. As an example, in one embodiment, the frame 64 is formed of polystyrene foam, although a wide variety of other rigid materials (e.g., polyurethane or polyethylene) are equally acceptable. In one embodiment, and with specific reference to FIG. 3, the frame 64 supports the thermoelectric device 54 and related components, and forms a conduit 68 and a reservoir 70. The conduit 68 extends in a vertical fashion (relative to the orientation of FIG. 3), and is open at opposing ends thereof. The thermoelectric device 54 and related components are mounted to an end of the conduit 68 opposing the bottom plate 22 (upon final assembly). To this end, and in one embodiment, the conduit 68 orients the thermoelectric device 54 and related components in horizontally declined fashion (as shown in FIG. 3). With this configuration, condensation on the cold sink 60 is guided (via gravity) away from the thermoelectric device 54/cold sink 60 for collection in the reservoir 70 as described below. Regardless, the second fan 58 is disposed within, or is otherwise fluidly connected to, the conduit 68, for drawing external air (via the opening 24 in the bottom plate 22) across the hot sink 62.

With reference to the cross-section shown in FIG. 3, the housing 12 defines a lower enclosed region 72 and an upper enclosed region 74. The thermoelectric assembly 14 is disposed in the lower enclosed region 72 and rests on the bottom plate 22 (alternatively, the thermoelectric assembly 14 can be more permanently mounted to the bottom plate 22). The thermoelectric device 54 and the fans 56, 58 are positioned above the first opening 24. In this regard, the first fan 56 is disposed above the thermoelectric device 54 and adapted to direct air cooled by the cold sink 60 across and upward into the product container assembly 18. The second fan 58 is positioned adjacent to the hot sink 62 and adapted to blow air across the hot sink 62 to convectively remove heat from the hot sink 62, thereby driving the Peltier Effect. The third fan 59 moves air over the reservoir 70 to evaporate collected condensate, and outwardly from the merchandizing unit 10 via the second opening 26 in the bottom plate 22. Because the air being moved by the third fan 59 is heated (via interface with the hot sink 62), it is thus expanded and more able to absorb moisture particles. Notably, the air baffle 30 prevents outgoing heated air (at the second opening 26) from mixing with incoming air (at the first opening 24), as it is desirable for incoming air to not be artificially heated (and thus more capable of driving the thermoelectric device 54).

The transition assembly 16 includes a frame 72 and a drain tube 74. The frame 72 is adapted for mounting to the frame 64 of the thermoelectric assembly 14 and surrounds the thermoelectric device 54, such that the thermoelectric device 54 is insulated. The frame 72 maintains the drain tube 74 that is otherwise fluidly connected to a passage 75 in a floor 76 of the frame 72, as shown generally in FIG. 3. An upper surface of the floor 76 is horizontally declined in manner similar to the orientation of the thermoelectric device 54 and related components such that condensate from the cold sink 60 flows along the floor 70 to the passage 76 and then through the drain tube 74. In one embodiment, the drain tube 74 is J-shaped, and extends to the reservoir 70 upon final assembly. Alternatively, other configurations for delivering condensate to the reservoir 70 can also be employed. In addition, a bottom surface of the floor 76 defines a channel 78 that is configured to direct airflow from the second fan 58 toward the second opening 26 in the bottom plate 22. Regardless, in one embodiment, the drain tube 74 is sealed within the frame 72 except at the passage 76; this feature, in combination with the preferred J-shape of the drain tube 74 renders the drain tube 74 as a P-trap that maintains a liquid seal between the cold sink 60 and the hot sink 62 to prevent warm air return or migration.

The product container assembly 18 includes an exterior frame 80 and an interior container 82 (drawn generically in FIG. 2), as best shown in FIG. 2. Upon final assembly, the exterior frame 80 and the interior container 82 combine to form a first air plenum or passageway 84 and a second air plenum or passageway 86 as identified in FIG. 3. To this end, and with additional reference to FIG. 4, the exterior frame 80 defines inner wall faces 90, 92, 94, and 96 and the interior container 82 has respective panels 100, 102, 104, and 106 that are dimensioned such that the panels 100, 102 nest against the respective faces 90, 92 and panels 104, 106 are spaced from the respective faces 94 and 96 to form the air plenums 84, 86.

Figure 4:
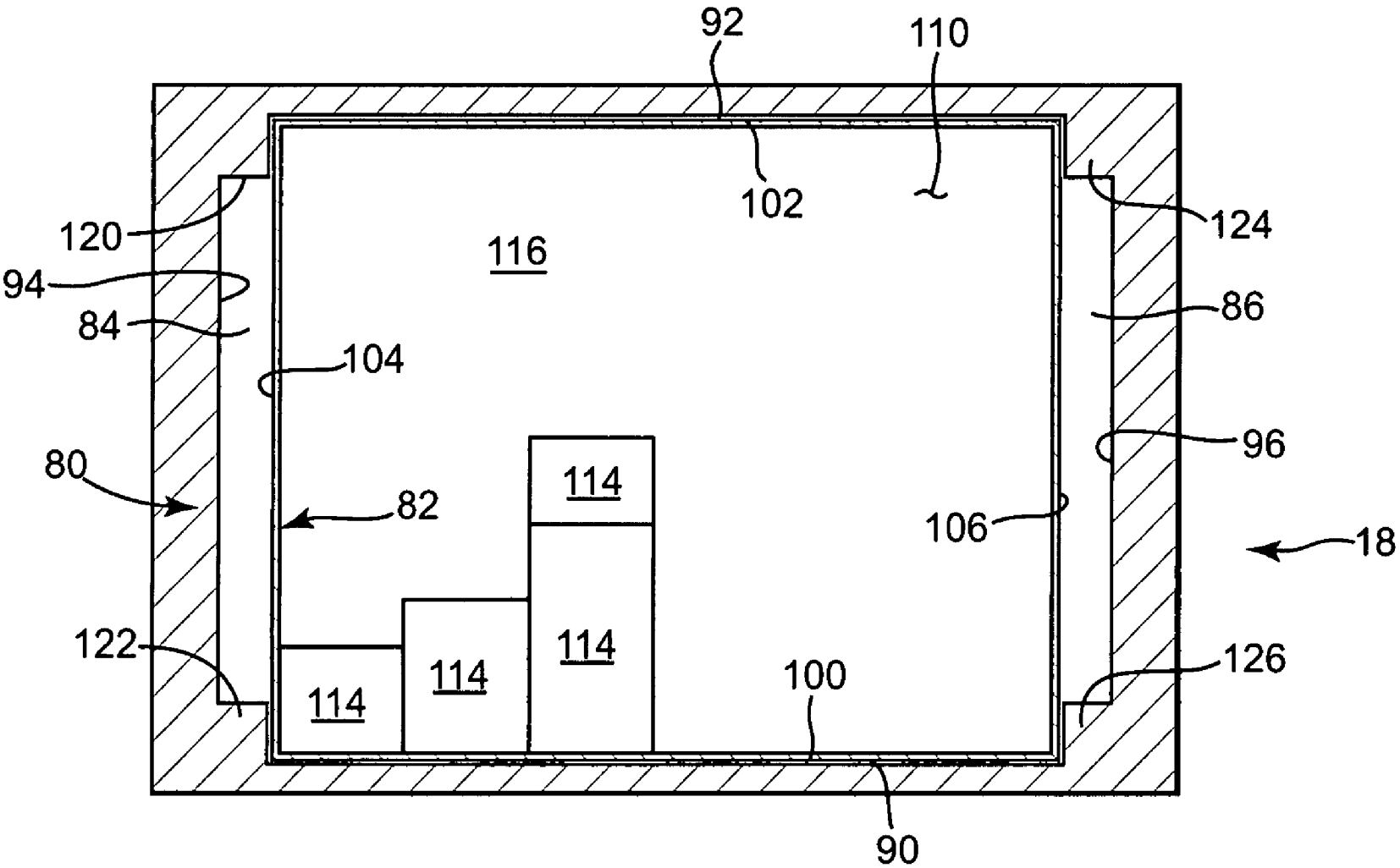
FIG. 4 is a cross-sectional view of the portable cooled merchandising unit of FIG. 3 showing a product container assembled within an insulating assembly according to one embodiment of the present invention.

The interior container 82 includes a floor 110 for supporting products 114 (shown schematically in FIGS. 3 and 4). The panels 100, 102, 104, and 106 of the interior container 82 extend from the floor 110 and combine to define an interior region 116 terminating at a major opening 118 (FIGS. 2 and 3). As shown in FIG. 3, the air plenums 84, 86 are fluidly connected to the interior region 116 opposite the floor 110 via the major opening 118 to allow airflow into and out of the interior region 116. Further, the interior region 116 is accessible, via the major opening 118, upon opening of the door 40 to facilitate placement and/or removal of the products 114 in the unit 10.

In one embodiment, the interior container 82 is disposed within the exterior frame 80 such that the panels 100, 102 of the interior container 82 frictionally fit against the respective wall faces 90, 92 of the exterior frame 80. To offset the panels 104, 106 of the interior container 82 from the faces 94 and 96 of the exterior frame 80, offset extensions 120, 122, 124, and 126 are formed by the exterior frame 80, as illustrated in FIG. 4. The offset extensions 120, 122, 124, 126 are depicted as uniformly orthogonal, however other shapes are acceptable. In particular, in one embodiment, the offset extensions 120, 122, 124, and 126 are formed at respective interior corners of the exterior frame 80 to structurally separate the panels 104, 106 of the interior container 82 from the faces 94 and 96 of the exterior frame 80, thus forming the respective first and second air plenums 84, 86. For example, the offset extensions 120, 122 project inward (i.e., toward the interior container 82) to define a relief slot that, in combination with the panel 104, forms the first air plenum 84 along an exterior portion of the panel 104. Similarly, the offset extensions 124, 126 project inward to define another relief slot that forms the second air plenum 86 in combination with an exterior portion of the panel 106. In this manner, the respective air plenums 84, 86 are formed as channels between the exterior frame 80 and the interior container 82. In a more preferred alternative embodiment described below, the faces 94, 96 of the exterior frame 80 form a series of channels that in turn define a series of plenum-like regions upon assembly of the interior container 82 within the exterior frame 80. Thus, the exterior frame 80 can have a wide variety of configurations apart from that shown capable of establishing airflow channels relative to an exterior of the panels 104, 106 of the interior container 82.

The air plenums 84, 86 are generally rectangular and define an approximately constant cross-sectional area as best shown in FIG. 3, although other shapes and conformations are equally acceptable. For example, the air plenums 84, 86 are each depicted as having approximately uniform cross-sections along their respective lengths extending between the transition assembly 16 to the door assembly 32. In this regard, the airflow up one plenum, for example the air plenum 86, balances with airflow down the other plenum, for example the air plenum 84. In this manner, the mass of airflows into and out of the interior container 82 is balanced. Alternately, the air plenums 84, 86 need not be mirror images. That is, the air plenums 84, 86 can define other geometries, for example converging and diverging airflow geometries, such that the airflow into and out of the interior container 82, while not identically balanced, still provides efficient cooling of the products 114. Further, a plurality of air plenums can be formed relative to each of the panels 104, 106 of the interior container 82.

In one embodiment, the interior container 82 is removably secured within the exterior frame 80 such that the interior container 82 can be withdrawn from the exterior frame 80 when desired. For example, the interior container 82 can be loaded with product apart from the exterior frame 80 (and other components of the merchandizing unit 10) and subsequently loaded into the exterior frame 80. To this end, the one embodiment in which the entire door assembly 32 is removably mounted relative to the product container assembly 18 promotes easy removal and replacement of the interior container 82. Alternatively, the exterior frame 80 and the interior container 82 can be integrally formed and/or assume other shapes or configurations varying from those depicted in the FIGS.. For example, the exterior frame 80/interior container 82 can be shaped to mimic a shape of the product(s) 114 contained therein. Additionally, a lighting source (e.g., light emitting diodes (LED)) can be added to an exterior of the housing 12, door assembly 32, and/or the interior container 82 to provide enhanced visibility of the product 114 and/or consumer awareness of the unit 10, as shown, for example, at 130 in FIG. 3. In one embodiment in which LEDs are used as the lighting source, the enhanced visibility is achieved without generating heat and while remaining within voltage limitations or considerations of the unit 10.

Figure 5A:
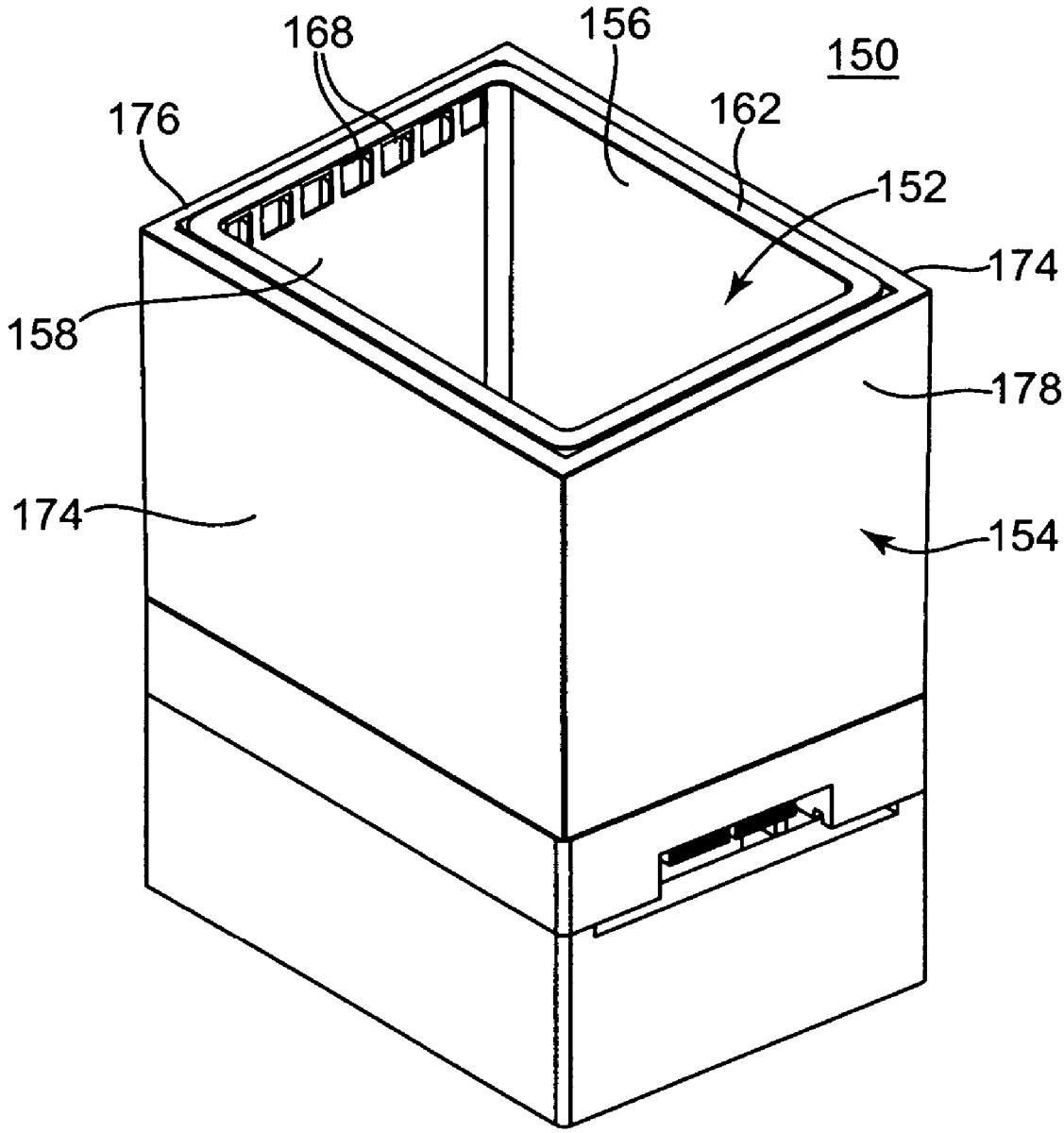
FIG. 5A is a side, perspective view of a portion of an alternative embodiment cooled merchandising unit in accordance with the present invention.
Figure 5B:
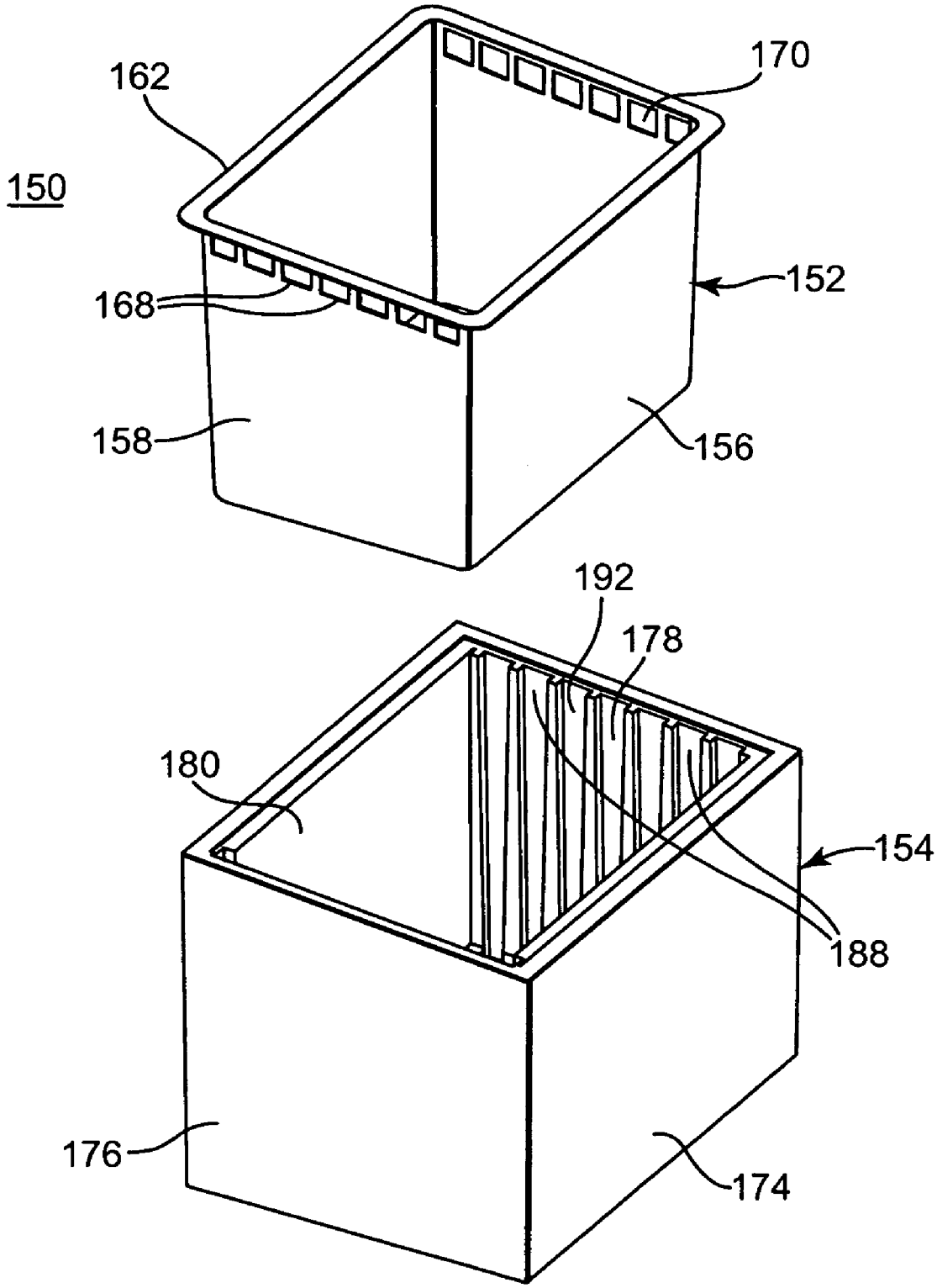
FIG. 5B is an exploded view of an exterior frame and interior container components of the merchandizing unit of FIG. 5A.
Figure 5C:
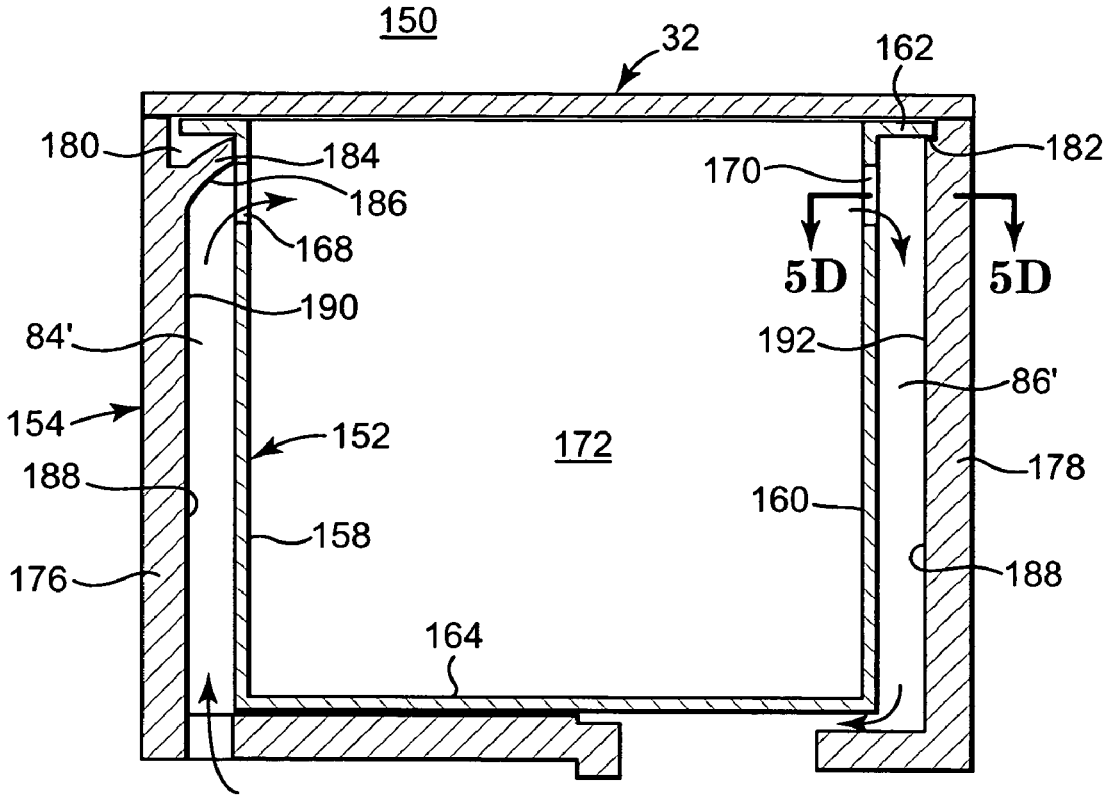
FIG. 5C is a side, cross-sectional view of a portion of the unit of FIG. 5A.

In a more preferred alternative embodiment, the interior container 82 is adapted to effectuate a more positive airflow across the plenums 84, 86. In particular, FIGS. 5A-5C illustrate an alternative embodiment cooling unit 150 including an interior container 152 secured within an exterior frame 154 (it being understood that the unit 150 can further include a housing akin to the housing 12 (FIGS. 1 and 2) previously described). As with previous embodiments, the interior container 152 and the exterior frame 154 combine to define air plenums 84' and 86' (FIG. 5C). However, the interior container 152 and the exterior frame 154 are adapted to better direct and control airflow.

The interior container 152 includes and integrally forms opposing side panels 156, opposing first and second end panels 158, 160, a flange 162, and a floor 164 (FIG. 5C). The flange 162 extends, in one embodiment, radially outwardly from the panels 156-160 opposite the floor 164. As described below, the flange 162 is adapted for selective mounting to the exterior frame 154. The interior container 152 is adapted to optimize airflow via apertures or windows 168 in the first end panels 158 and apertures or windows 170 (hidden in FIG. 5A) in the second end panels 160. Each of the apertures 168, 170 extend through a thickness of the corresponding panels 158, 160, establishing an airflow path between an exterior of the interior container 152 and an interior region 172 (FIG. 5C). Upon final assembly, and as described below, the first end panel apertures 168 allow airflow from the air plenum 84' to the interior region 172, and the second end panel apertures 170 facilitate airflow from the interior region 172 to the air plenum 86'.

The exterior frame 154 is similar to the exterior frame 80 (FIG. 2) previously described, and includes opposing side walls 174, first and second end walls 176, 178, and a bottom (not shown). The walls 174-178 combine to define an opening 180 sized to receive the interior container 152. To this end, and in one embodiment, a ledge 182 (best shown in FIG. 5C) is formed along the walls 174-178 and is adapted to receive the flange 162 of the interior container 152. In addition, in one preferred embodiment, the first end wall 176 forms, or has attached thereto, an inwardly-extending deflector body 184 (best shown in FIG. 5C). The deflector body 184 defines a guide surface 186 oriented and positioned to direct airflow from (or as a terminating part of) the air plenum 84' toward the first end panel apertures 168 (and thus the interior region 172) upon final assembly of the interior container 152 and exterior frame 154. In one embodiment, the guide surface 186 is curved or arcuate, providing a smooth airflow guide. Regardless, the deflector body 184 (as well as the flange 162) separates the door assembly 32 (drawn schematically in FIG. 5C) from the air plenum 84'. Thus, airflow from the supply plenum 84' does not interface with the door assembly 32. Further, where the deflector body 184 is formed of an insulative material (e.g., foam), possible heat transfer at the door assembly 32 due to the cooled nature of air through the supply plenum 84' is minimal. In this manner, condensate is less likely to form along the door assembly 32.

Figure 5D:
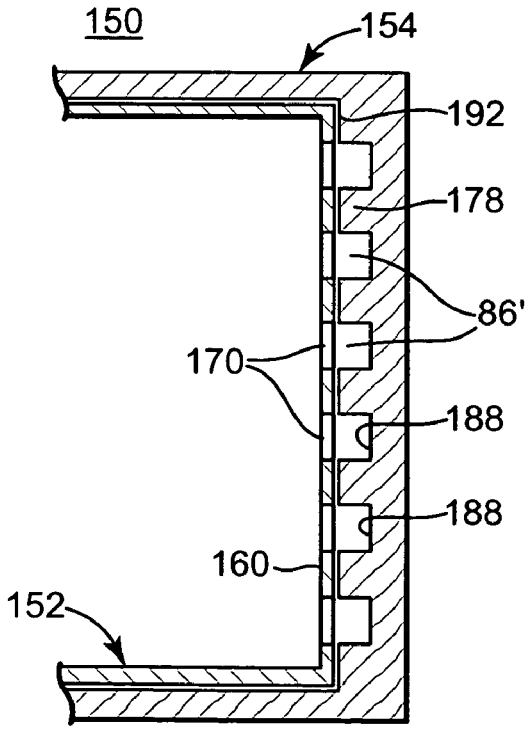
FIG. 5D is a simplified, top cross-sectional view of a portion of the merchandizing unit of FIG. 5A.

In addition, in one embodiment, the exterior frame end walls 176, 178 form a plurality of longitudinal channels 188 (FIG. 5A) along an inner face 190, 192, respectively, thereof (it being understood that the in view of FIG. 5A, the channels associated with the first end wall 176 are hidden). The channels 188 are sized and positioned to correspond with respective ones of the apertures 168 or 170 upon final assembly. For example FIG. 5D illustrates a simplified, partial, top cross-sectional view of the assembled interior container 152/exterior frame 154, and in particular a relationship between the second end panel 160 of the interior container 152 and the second end wall 178 of the exterior frame 154. As shown, the channels 188 defined by the exterior frame second end wall 178 are generally aligned with the apertures 170 of the interior container second end panel 160. In one embodiment, the channels 188 effectively establish a plurality of the return plenums 86', although the interior container second end panel 160 need not necessarily be sealed against the inner face 192 of the exterior frame second end wall 178 such that only a single return plenum 86' is defined. Alternatively, the channels 188 can be eliminated, as with the exterior frame 80 (FIG. 2) previously described. Regardless, and with specific reference to the arrows in FIG. 5C, during use, cooled airflow is directed through the supply plenum(s) 84', through the apertures 168 (via the deflector body 184), and into the interior region 172. Simultaneously, airflow is directed from the interior region 172, through the apertures 170, and into the return plenum(s) 86' for subsequent cooling as previously described.

Returning to the embodiment of FIGS. 2-4, the merchandizing unit 10 is assembled by securing the frame 72 of the transition assembly 16 onto the frame 64 of the thermoelectric assembly 14 as shown in FIG. 3. To this end, the floor 76 of the frame 72 is secured about the thermoelectric device 54, supporting the horizontally declined orientation of the thermoelectric device 54 and related components (e.g., the fans 56, 58 and the heat sinks 60, 62). The thermoelectric assembly 14/transition assembly 16 is then placed within the housing 12 such that the frame 64 of the thermoelectric assembly 14 rests on the bottom plate 22. In particular, the conduit 68 is fluidly aligned with the first opening 24 in the bottom plate 22, whereas the reservoir 70 is fluidly open to the second opening 26. The product container assembly 18 is then positioned within the housing 12, secured to the frame 72 of the transition assembly 16. Finally, the door assembly 32 is mounted to the product container assembly 18 such that the door 36 is over the major opening 118 of the interior container 82. With this one construction (and with the alternative embodiment of FIGS. 5A-5D), the thermoelectric device 54 and related components (in particular, the cold sink 60 and the first fan 56) are positioned below (relative to an upright orientation of the unit 10) the floor 110 of the interior container 82. Thus, the thermoelectric device 54, the cold sink 60, and the first fan 56 are not above the interior container 82 therein. As described in greater detail below, this preferred construction obviates possible flow of condensation from the cold sink 60 onto the product 114. Alternatively, the merchandizing unit 10 can be configured such that the thermoelectric device 54, the cold sink 60, and/or the first fan 56 are positioned to a side of the interior container 82.

In one embodiment as best shown in FIG. 3, upon final assembly the air plenums 84, 86 extend from the thermoelectric assembly 14 to the major opening 118, and thus are fluidly connected to the interior region 116 when the door 36 is "closed". To facilitate air movement between the air plenums 84, 86 (and with the alternative embodiment of FIGS. 5A-5D), in one embodiment the transition assembly 16 and the product container assembly 18 combine to define a transition plenum 130 that fluidly connects the first and second plenums 84, 86. With this construction, airflow can circulate (via the first fan 56) from the thermoelectric device 54, through the transition plenum 130, through the first plenum 84, and into the interior region 116; from the interior region 116, through the second plenum 86, and back to the thermoelectric device 54.

When assembled and operated, the products 114 are cooled by a cascading flow of cooled air into the interior region 116 of the interior container 82 and onto the products 114. In particular, the convective cooling of the products 114 is facilitated by circulation of cooled air through the air plenums 84, 86. In a preferred embodiment, the first fan 56 is employed to draw air across the cold sink 60, thus cooling the air, and forcing the cooled air through the transition plenum 130 and up (with respect to the orientation of FIG. 3) the first or supply plenum 84 and into the major opening 118 of the interior container 82. The cooled air cascades into the interior region 116, cooling the products 114. Airflow is simultaneously drawn (via operation of the first fan 56) from the interior region 116 via the major opening 118, down through the second or return plenum 86. This returned air is drawn across the cold sink 60 and thus cooled before being directed to the supply plenum 84. As previously described, the thermoelectric device 54 operates to continuously cool the cold sink 60. In addition, the second fan 58 directs air across the hot sink 62 to dissipate heat from the hot sink 62, thus driving the Peltier Effect of the thermoelectric device 54 (i.e., an increase in the removal of heat from the hot sink 62 couples with an increase in thermal absorption at the cold sink 60, thus the thermoelectric device 54 "resonates" and cools more effectively). The alternative embodiment of FIGS. 5A-5D operates in an identical manner.

In addition, any condensate that might form on the thermoelectric device 54/cold sink 60 is transported via the drain tube 74 into the reservoir 70. Specifically, condensation that forms on or near the thermoelectric device 54 is channeled along the floor 76 of the frame 72 and expelled, via the passage 75, through the drain tube 74 into the reservoir 70. In one embodiment, airflow from the first fan 56 serves to further sweep or direct condensate along the floor 76 toward the passage 75/drain tube 74. In a preferred embodiment, the third fan 58 is operated to evaporate moisture collected within the reservoir 70.

In a preferred embodiment, the thermoelectric device 54 is positioned under the interior container 82, and more specifically, under the floor 110 of the interior container 82. With this in mind, any condensate formed on or near the thermoelectric device 54 cannot drip into the interior container 82, or onto the products 114 in the interior container 82. In fact, condensate that forms on the thermoelectric device 54 is expelled through the drain tube 74 to the reservoir 70 where the moisture is retained until it is removed or convectively evaporated by the fan 59. Therefore, the airflow through the air plenums 84, 86 cools the products 114, and condensate that might form on or near the thermoelectric device 54 is transported away from the product container assembly 18 and subsequently evaporated.

Figure 6:
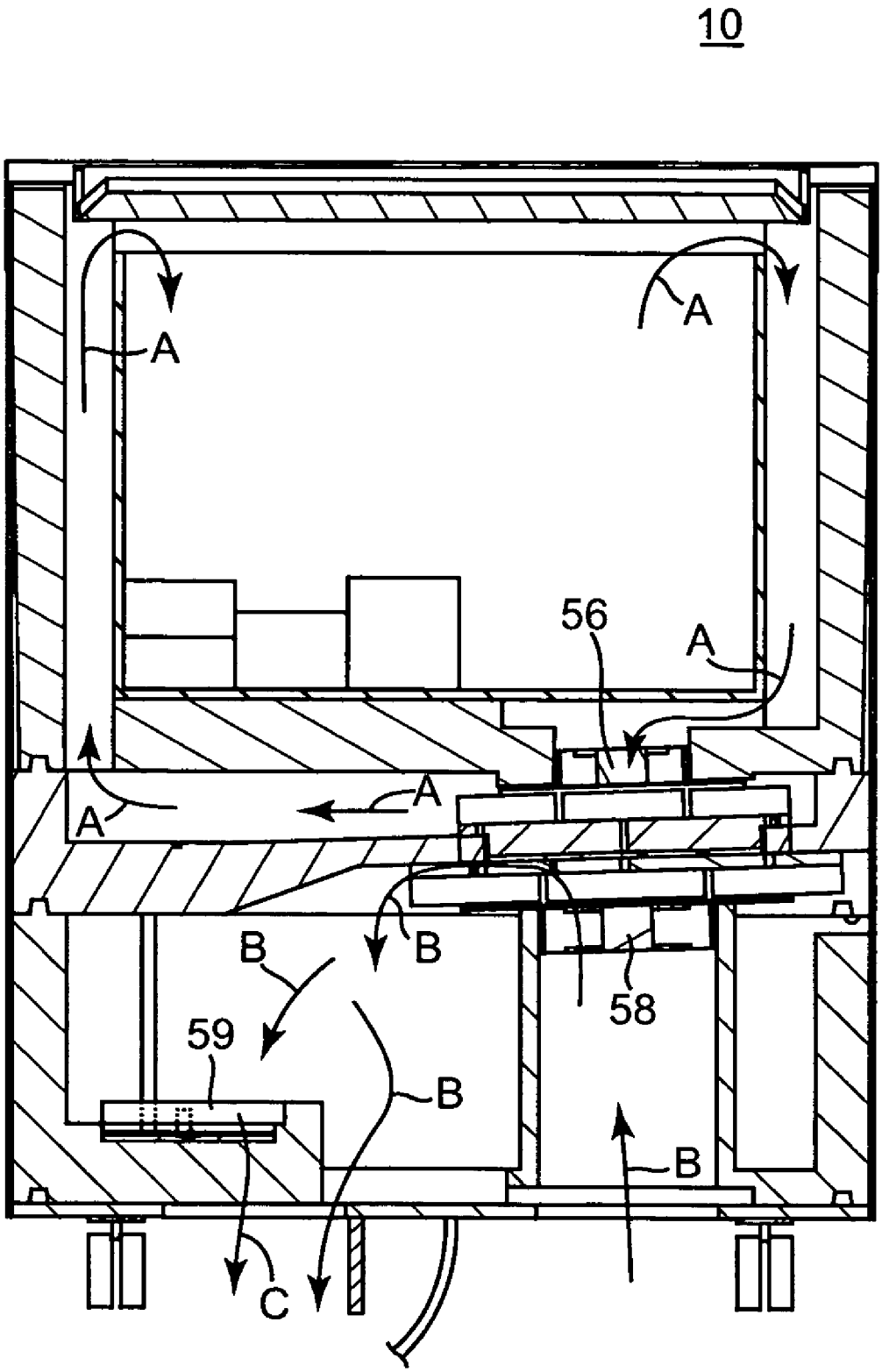
FIG. 6 is the front cross-sectional view of FIG. 3 with arrows indicating an airflow pattern in accordance with one embodiment of the present invention.

Consonant with the above description, in one embodiment air is circulated through the merchandizing unit 10 (and the merchandising unit 150 of FIGS. 5A-5D) in a "one way" flow path. FIG. 6 illustrates airflow patterns associated with the first fan 56 (arrows "A"), the second fan 58 (arrows "B"), and the third fan 59 (arrow "C"). In an alternate embodiment and returning to FIG. 3, the air plenums 84, 86 are each employed to facilitate the delivery of cooled air from the thermoelectric device 54 into the interior container 82. That is to say, in one embodiment the air plenums 84, 86 are each operated as a supply plenum adapted to blow cooled air into the interior container 82 and onto the products 114.

An example of the portable cooled merchandising unit 10 employed to cool products 114 in a grocer's display area is described with reference to FIG. 3. The products can assume a wide variety of forms, and need not be identical (in terms of packaging shape and/or contents). For example, the products 114 can be packaged food items that are normally cooled such as dairy products, meat products, produce, frozen food items, etc., to name but a few. During use, the portable merchandizing unit 10 is typically positioned in a high traffic area of the grocery store and operated to cool the products 114 in the interior container 82. In this regard, multiple merchandizing units 10 can be positioned side-by-side, especially during promotional events. The wheels 28 elevate the housing 12 off of the display floor (not shown) to facilitate air movement into the air intake 24 and out of the air outlet 26 of the bottom plate 22, with the air baffle 30 preventing mixing of heated air from the air outlet 26 with air entering the air intake 24. In one embodiment, the interior container 82 is loaded with the product 114 prior to assembly to the housing 12/exterior frame 80. The door assembly 32 is simply removed from the housing 12 and then the interior container 82/product 114 is placed within the exterior frame 80. With this one embodiment, multiple interior containers 82 (each containing same or different product 114) can be stored at a separate location and delivered to the merchandizing unit 10 as desired by the user. A partially or completely empty interior container 82 can be removed and replaced by a second interior container 82 having desired product 114. The alternative embodiment unit 150 of FIGS. 5A-5D is similarly constructed.

Figure 7A:
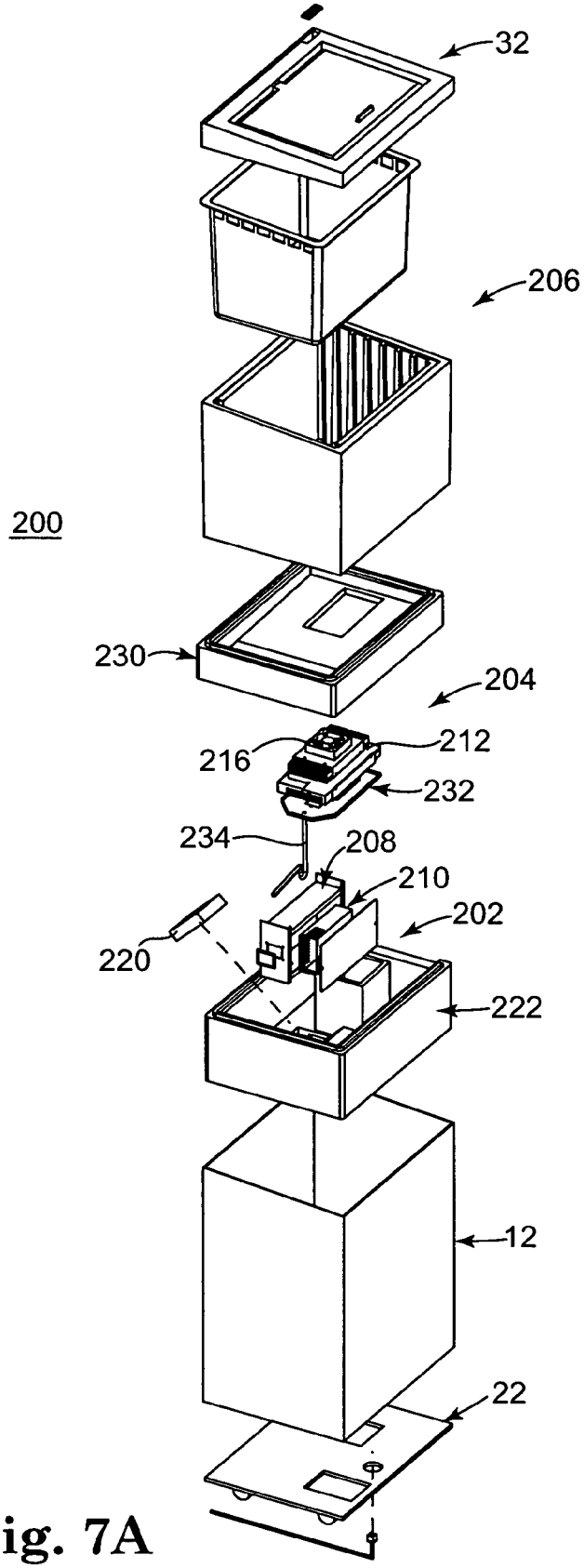
FIG. 7A is an exploded view of an alternative embodiment cooled merchandizing unit in accordance with the present invention.
Figure 7B:
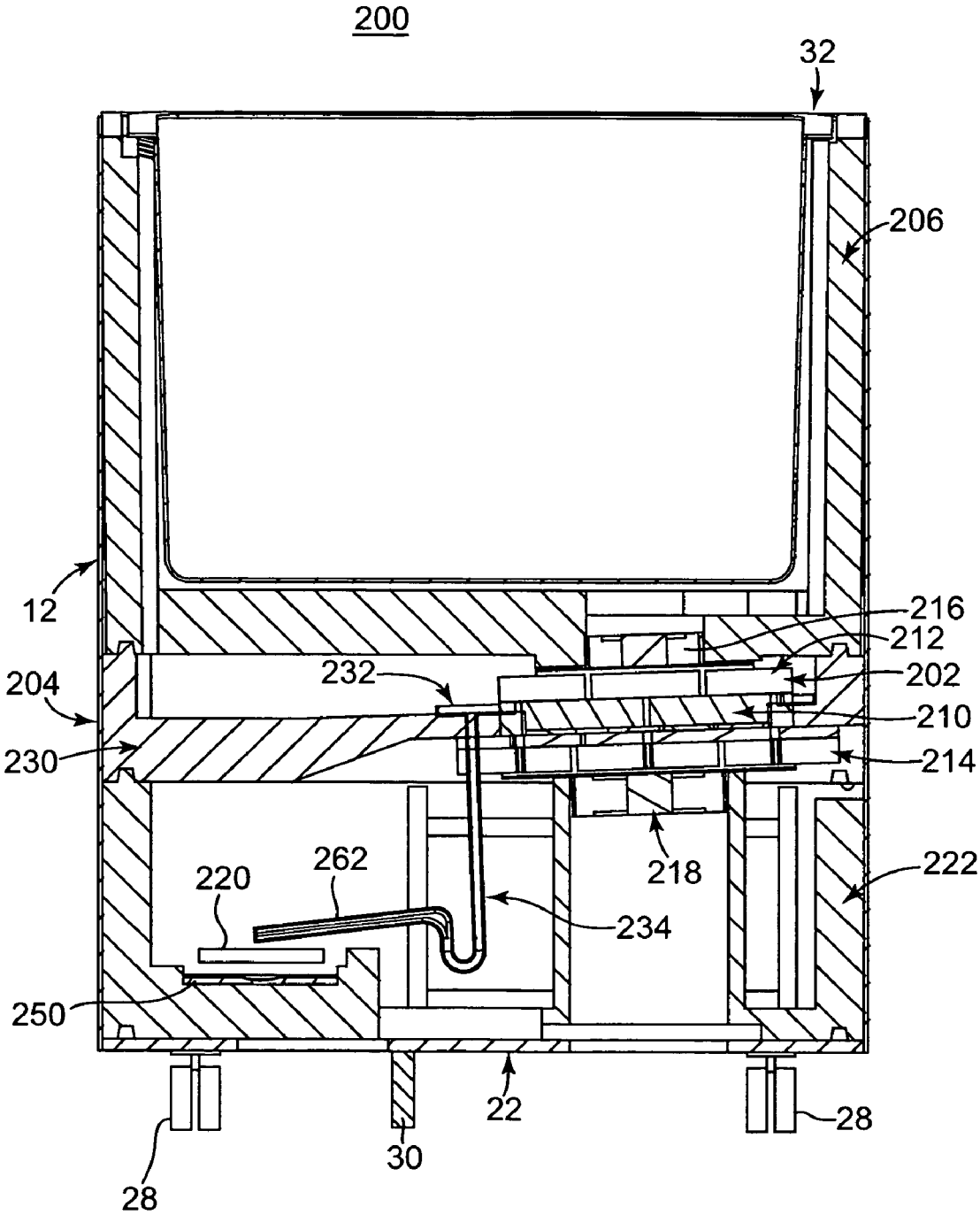
FIG. 7B is a cross-sectional view of the merchandizing unit of FIG. 7A.

The cooled merchandizing units 10, 150 described above are capable of operating as refrigeration units or as freezer units. In certain respects, however, when operated at freezer-like temperatures (e.g., 0° F.-32° F.), it may be necessary to more actively control accumulated ice/water during necessary defrosting cycles. With this in mind, an alternative embodiment cooled merchandizing unit 200 in accordance with the present invention is shown in FIGS. 7A and 7B. In many respects, the merchandizing unit 200 is highly similar to the embodiments 10, 150 previously described, and includes a thermoelectric assembly 202, a transition assembly 204, and a product container assembly 206. In addition, the merchandizing unit 200 can further include the housing 12 (identical to that previously described with respect to FIG. 2), the door assembly 32 (identical to that previously described with respect to FIG. 2), and the bottom plate 22 (identical to that previously described with respect to FIG. 2) having, for example, the casters 28 or similar support bodies and the baffle 30. Regardless, the transition assembly 204 supports the product container assembly 206 relative to the thermoelectric assembly 202, and facilitates below-freezing operations as described below.

The thermoelectric assembly 202 is similar to the thermoelectric assembly 24 (FIG. 2) previously described, and includes a control unit 208 (FIG. 7A), a thermoelectric device 210, a heat sink (referenced to herein as "cold sink") 212, a heat sink (referenced to herein as "hot sink") 214, first, second, and third fans 216-220 (with the third fan 220 being shown schematically in FIG. 7B for ease of illustration), and a frame 222 maintaining the various components 210-220. Assembly and operation of the thermoelectric device 210 (via the power control unit 208 and associated programming) to cool the cold sink 212, as well as to operate the fans 216-220 is highly similar to that previously described relative to the thermoelectric assembly 14, though can incorporate operational cycling capabilities appropriate for maintaining frozen product (not shown) within the product container assembly 206, as described below. To this end, in one embodiment, the thermoelectric device 210 includes a plurality of thermoelectric chips for more readily achieving the large delta T necessary for freezer applications (as compared to a single chip design normally utilized with refrigeration-type applications). Thus, the thermoelectric device 210 can include a multi-layered or sandwiched chip design as is known in the art; alternatively, a cascading chip design or other configuration is equally acceptable.

Figure 8:
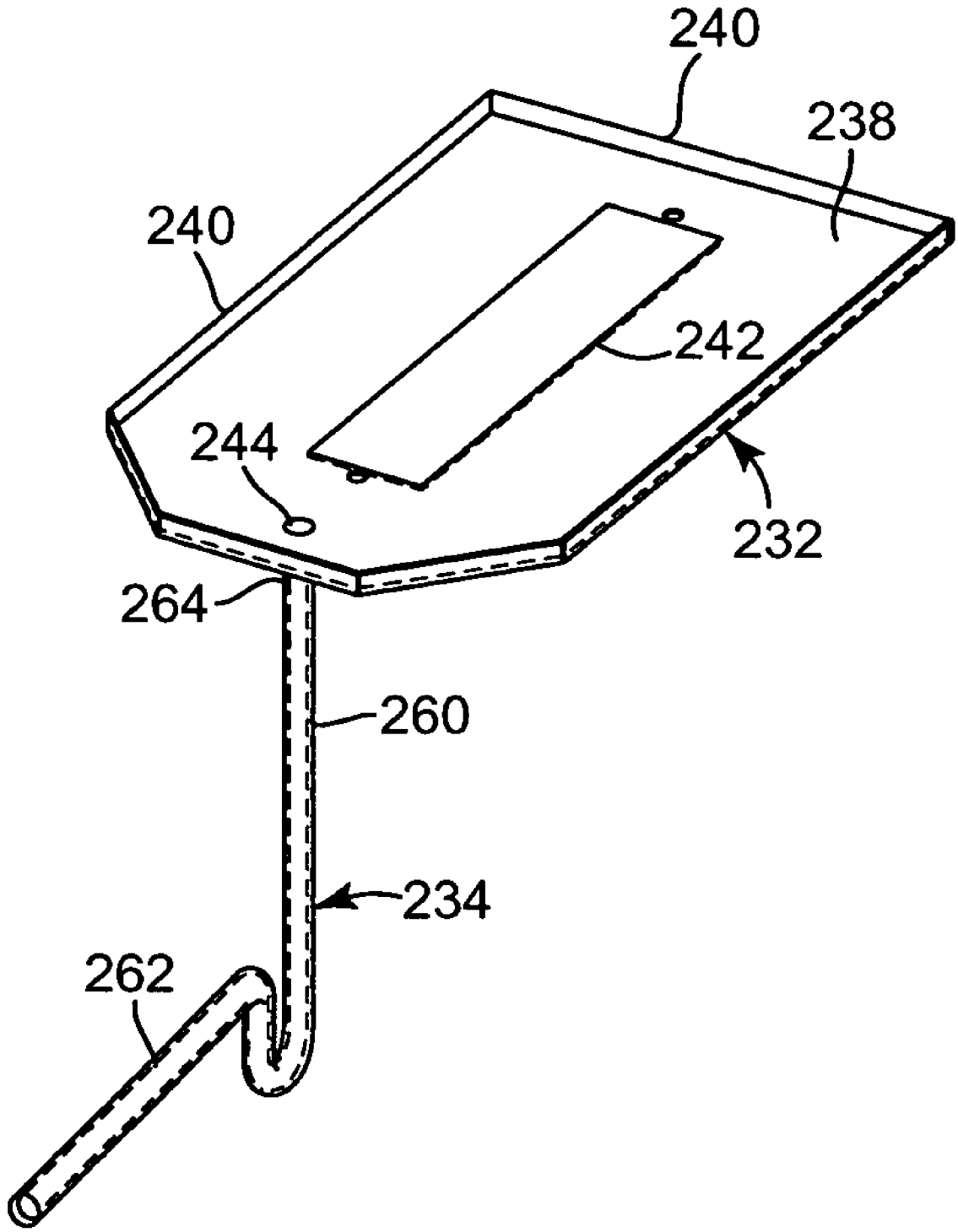
FIG. 8 is a perspective view of pan and drain tube components of the merchandizing unit of FIG. 7A.

Regardless of the exact configuration of the thermoelectric assembly 202, when the merchandizing unit 200 is operated to maintain frozen product, ice will necessarily accumulate along the cold sink 212. From time-to-time, and as described below, it will be necessary to remove the accumulated ice via a defrost mode of operation. The transition assembly 204 is adapted to consistently promote removal of the melting ice from the cold sink 212. In particular, in one embodiment, the transition assembly 204 includes a frame 230, a pan 232, and a drain tube 234. The frame 230 is adapted for mounting to the frame 222 of the thermoelectric assembly 202, and maintains the pan 232 and the tube 234. More particularly, the frame 230 defines a floor 236 on which the pan 232 rests and forms an aperture (not shown) through which the tube 234 passes. With additional reference to FIG. 8, the pan 232 includes a base 238 and perimeter side walls 240. The base 238 forms a passage 242 sized in accordance with the cold sink 212 and the thermoelectric device 210. In particular, the passage 242 is sized such that the base 238 can be directly assembled to the cold sink 212. In addition, the base 238 forms an aperture 244 sized for fluid connection to the tube 234.

In one embodiment, the pan 232 is formed of a rigid, heat conductive material, preferably aluminum. When assembled to the cold sink 212, then, the pan 232 readily conducts heat (or lack of heat) as generated by the cold sink 212. Thus, as ice forms within the fins associated with the cold sink 212 during operation of the unit 200 as a freezer, additional ice will also form within the pan 232. Subsequently, during a defrost operational mode (described below), polarity of the thermoelectric device 210 is reversed, such that the cold sink 212 heats or becomes a hot sink. This, in turn, causes the accumulated ice to melt. The side walls 240 maintain the now melted water within the pan 232, with an angular orientation of the pan 232 (shown in FIG. 7) directing the water toward the aperture 244, and thus the tube 234. By way of reference, under most circumstances, the melting of accumulated ice from the cold sink 212 occurs in a relatively slow, continuous fashion. As such, the pan 232 can be of fairly limited size, having a length on the order of 20-40 cm and a width on the order of 10-25 cm. Further, the side walls 240 have a height on the order of 5-10 mm, although other dimensions are equally acceptable. By preferably limiting an overall size of the pan 232, however, savings in material costs are realized, and only a nominal affect, if any, or airflow through a transition plenum 246 (established between the frame 230 and the product container assembly 206) occurs.

As indicated above, the pan 232 directs water (i.e., melted ice) toward the aperture 244 and thus the tube 234 via an inclined orientation dictated by the frame 230. In this regard, the frame 222 associated with the thermoelectric assembly 202 is, in one embodiment, identical to the frame 64 (FIG. 3) previously described and thus forms a reservoir 250 (FIG. 7B). Due to the preferred size of the pan 232 as described above, the point at which water drains from the transition assembly 204 is offset from the reservoir 250 (as compared to the aligned location of the passage 75 relative to the reservoir 70 with the embodiment of FIG. 3). With this in mind, the tube 234 includes a leading portion 260 and a trailing portion 262. The leading portion 260 defines a J-tube to establish a P-trap as previously described. The trailing portion 262 extends from an end of the leading portion 260 opposite the pan 232 and has a length sufficient to extend over the reservoir 250 upon final assembly. As best shown in FIG. 7B, the trailing portion 262 is configured such that upon final assembly, a slight, vertically downward orientation or extension is established so as to ensure desired liquid flow from the pan 232 to the reservoir 250. Subsequently, the third fan 220 can be operated to evaporate water collected within the reservoir 250 as previously described. At least a section of the leading portion 260 of the drain tube 234 is formed of a material conducive for sealed assembly to the pan 232. For example, in one embodiment and with reference to FIG. 8, a leading end 264 of the drain tube 234 is formed of a metal that can be welded to the pan 232. In another embodiment, the leading portion 260 further includes a low heat conducive material (e.g., plastic, rubber, etc.) between the metallic leading end 264 and a remainder of the leading portion 260 (that is otherwise metal to more rigidly define the J-bend) to minimize heat transfer between the cold sink 212/pan 232 and the reservoir 250.

Returning to FIGS. 7A and 7B, when operated to maintain frozen product, the thermoelectric power control unit 208 can make use of a control sequence differing from that previously described with respect to the merchandizing unit 10, 150. For example, in one embodiment, the control unit 2-208 includes, or is connected to, a first temperature sensor (not shown) located to sense temperatures at or in the product container assembly 206 and a second temperature sensor (not shown) positioned to sense temperatures at the cold sink 212. When initially powered, the power control unit 208 receives temperature information from the first temperature sensor. When the sensed temperature within the product container assembly 206 exceeds a set point, the power control unit 208 initializes a cooling sequence in which power is delivered to the thermoelectric device 210. In this initial state, both the second and third fans 218, 220 are powered on. Temperature information from the cold sink 212 (i.e., the second temperature sensor) is then monitored. Once the cold sink 212 temperature is at or below a desired set point (e.g., 32° F.), the control unit 208 initiates operation of the first fan 216, thereby initiating airflow through the product container assembly 206 in a manner akin to that previously described with respect to the units 10, 150. As cooled air is delivered to the product container assembly 206, the temperature sensor associated therewith (i.e., the first temperature sensor) provides the control unit 208 with temperature information. As the temperature within the product container assembly 206 approaches a pre-determined set point, the control unit 208 regulates power delivered to the thermoelectric device 210 via pulse width modulation. For example, in one embodiment, the control unit 208 operated to reduce power delivered to the thermoelectric device 210 to about 10% of full power. Conversely, as the temperature within the product container assembly 206 is determined to be increasing (i.e., thereby indicating a demand for increased cooling), the control unit 208 operates to increase the pulse width modulation of power delivered to the thermoelectric device 210 in a ramped manner, increasing power delivered to the thermoelectric device 210 back to 100%.

Once again, with the merchandizing unit 200 is operated to maintain frozen product, ice will accumulate on the cold sink 212, such that defrosting is necessary. In one embodiment, the control unit 208 is adapted or programmed to perform a defrost sequence at predetermined time intervals (e.g., every 24 hours). In one embodiment, the defrost sequence consists of first ramping down power delivered to the thermoelectric device 210 to 0% over a two minute period. A polarity of the DC power current delivered to the thermoelectric device 210 is then reversed, such that the cold sink 212 heats and the hot sink 214 cools. In one embodiment, this reversed polarity power delivery is ramped up to 100% over a two minute period. During this operation, the cold sink 212 will quickly rise in temperature (as will the pan 232). Once the control unit 208 determines that a temperature of the cold sink 212 (via the cold sink temperature sensor) has risen above freezing (i.e., 32° F.), the control unit 208 deactivates the first fan 216. As the cold sink 212 (and thus the pan 232) temperature continues to rise, accumulated ice will begin to melt, with the pan 232/tube 234 directing the water to the reservoir 250. Heating of the cold sink 212 continues until a temperature thereof exceeds a predetermined set point (e.g., 50° F.). Once the set point is exceeded, the control unit 208 will begin a defrost sequence termination cycle. For example, in one embodiment, the control unit 208 operates to ramp down power delivered to the thermoelectric device 210 to 0% over a two minute period. Power delivery remains at 0% for an additional two minute period to allow all defrosted water to drip from the cold sink 212, draining to the reservoir 250 via the pan 232/tube 234. The control unit 208 then operates to reverse polarity of the DC power current delivered to the thermoelectric device (i.e., to the normal operating polarity). Power delivered to the thermoelectric device 210, via the control unit 208, is then ramped up over a two minute period to 100%. Once a temperature of the cold sink 212 (via the second temperature sensor) is determined to be below freezing (e.g., 32° F.), the control unit 208 operates to activate the first fan 216. At this point, the defrost sequence is complete and normal operation is resumed. With this one preferred defrost sequence, the ramp up and down periods prevent thermal shock from damaging the thermoelectric device 210. Alternatively, however, other defrost operations can be utilized.

Figure 9:
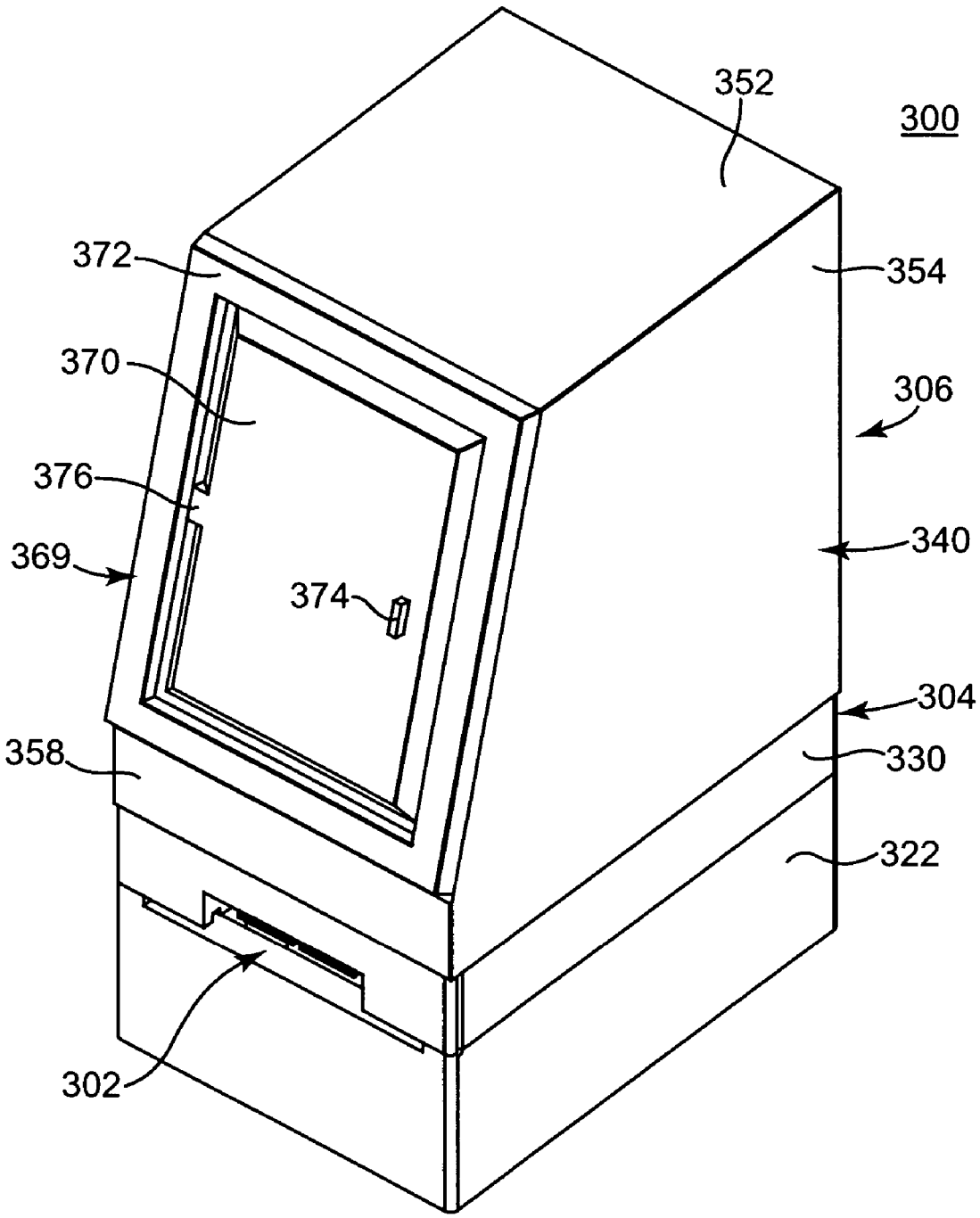
FIG. 9 is a perspective view of a portion of another alternative embodiment cooled merchandizing unit in accordance with the present invention.
Figure 10:
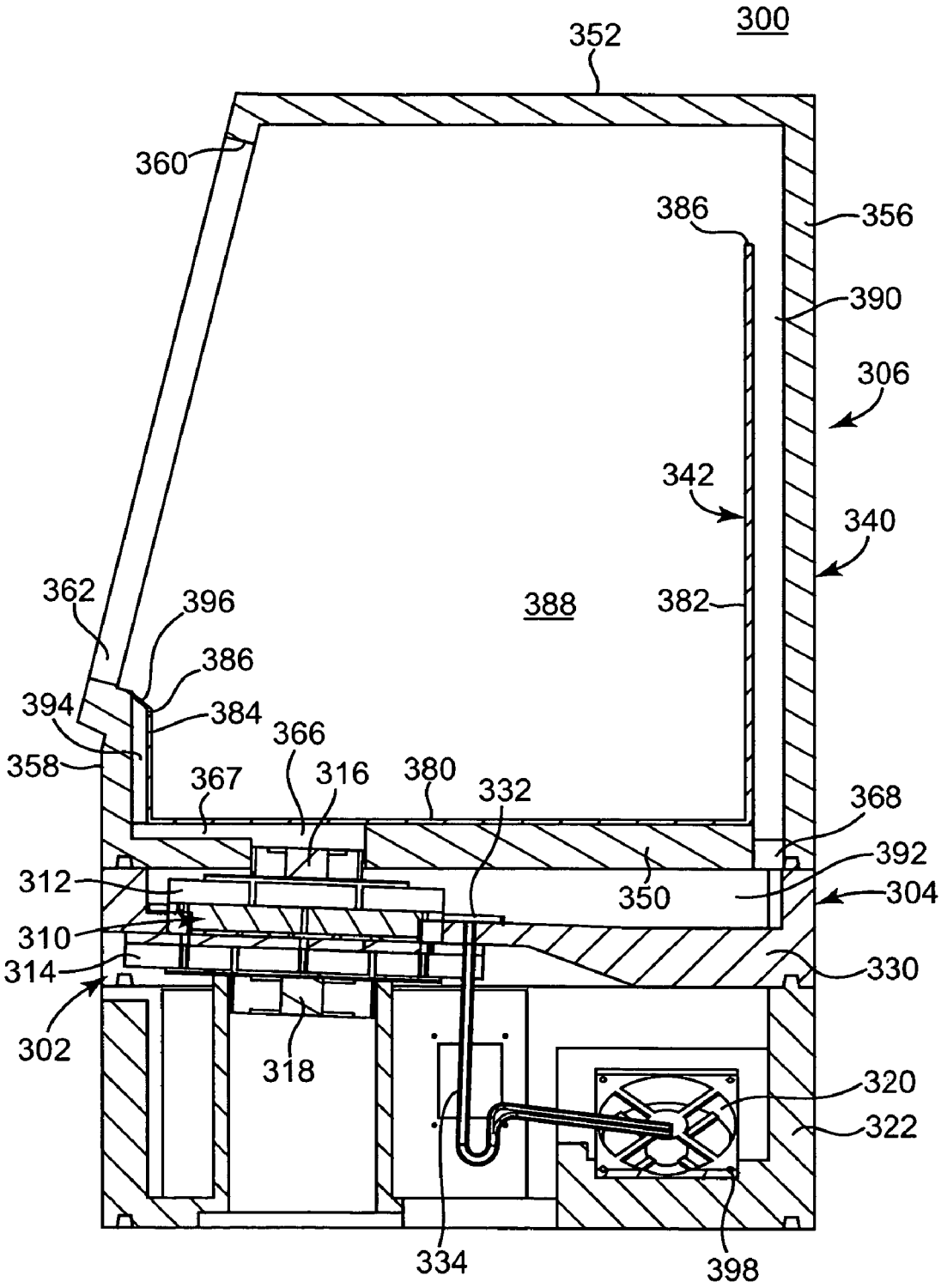
FIG. 10 is a cross-sectional view of the merchandizing unit of FIG. 9.

In another alternative embodiment, cooled merchandizing unit 300 is shown in FIGS. 9 and 10. The merchandizing unit 300 is similar in many respects to previous embodiments, and is capable of functioning as either a refrigeration unit or a freezer unit. Thus, the merchandizing unit 300 includes a thermoelectric assembly 302, a transition assembly 304, and a product container assembly 306. Though not shown, the merchandizing unit 300 can include additional components previously described with respect to the merchandizing unit 10 (FIG. 2) such as, for example, a housing (that would otherwise cover at least the electrical components shown as exposed in FIG. 9), a bottom plate, wheels, air baffle, etc. Regardless, the transition assembly 304 maintains the product container assembly 306 relative to the thermoelectric assembly 302. During operation, the thermoelectric assembly 302 operates to provide cooled airflow to product (not shown) maintained within the product container assembly 306.

In one embodiment, the thermoelectric assembly 302 is generally identical to the thermoelectric assemblies 14 (FIG. 2), 202 (FIG. 7A) previously described. In general terms, and as best shown in FIG. 10, the thermoelectric assembly 302 includes a control unit (not shown), a thermoelectric device 310, a cold sink 312, a hot sink 314, first, second, and third fans 316-320, and a frame 322. The thermoelectric device 310 can incorporate a multiple chip configuration (e.g., for freezer-type applications) or a single chip configuration (e.g., for refrigeration-type applications). Similarly, the control unit (that can be connected to one or more temperature sensors (not shown)) can be programmed for freezer-type operations or refrigeration-type operations. Operation of the thermoelectric assembly 302 is described in greater detail below.

Similarly, in one embodiment, the transition assembly 304 is identical to the transition assembly 204 previously described with respect to FIGS. 7A and 7B. In general terms, the transition assembly 304 includes a frame 330, a pan 332, and a drain tube 334. As previously described, the pan 332 and the tube 334 are, in one embodiment, adapted to facilitate operation of the merchandizing unit 300 as a freezer, and in particular, to facilitate periodic defrosting of the cold sink 312. Alternatively, the transition assembly 304 can assume a variety of other forms, such as the transition assembly 16 (FIG. 2) previously described.

As should be clear from the above, the thermoelectric assembly 302 and the transition assembly 304 can assume any of the forms previously described. In fact, in one preferred embodiment, the merchandizing unit 300 (as well as the merchandizing units 10, 150, 200) has a modular design whereby the product container assembly 306 (or any of the other product container assemblies previously described) can be easily interchanged with a desired configuration of the thermoelectric assembly 302 and the transition assembly 304. With this in mind, the product container assembly 306 has a generally "upright" configuration (as opposed to the "coffin" style associated with previous embodiments) and includes, as best shown in FIG. 10, an exterior frame 340 and an interior container 342. As described in greater detail below, the interior container 342 is disposed within the exterior frame 340 and establishes a platform for maintaining and displaying product (not shown).

The exterior frame 340 includes a base 350 (FIG. 10), a top wall 352, side walls 354 (one of which is shown in FIG. 9), a back wall 356 (FIG. 10), and a front wall 358 including a flange 360 (FIG. 10) defining an opening 362 (FIG. 10). The base 350 is adapted for mounting to the frame 330 of the transition assembly 304, such as by a tongue-in-groove design. In addition, the base 350 forms a passage 366, a first channel 367, and a second channel 368. The passage 366 is sized in accordance with the first fan 316 and is positioned such that upon assembly, the passage 366 is fluidly aligned with the first fan 316. The first channel 367 extends from the passage 366 toward the front wall 358 and establishes an airflow path to the passage 366 (and thus the first fan 316). The second channel 368 is formed adjacent the back wall 356 and establishes an airflow path to an air plenum, as described in greater detail below.

The flange 360 is configured to receive and maintain a door assembly 369 (FIG. 9) that otherwise encompasses the opening 362. To facilitate a better understanding of the various components, the door assembly 369 is omitted from the view of FIG. 10. The door assembly 369 includes a door 370 pivotally mounted to a sash 372 that in turn is adapted for assembly to the flange 360. In one embodiment, the door 370 includes a handle 374 and a stop 376. In one embodiment, the flange 360 defines the angular orientation reflected in FIGS. 9 and 10 such that when the door 370 is grasped at the handle 374 and pulled open (i.e., pivoting relative to the sash 372 along a hinge disposed opposite the handle 374), the door 370 will naturally return to a closed position via gravity when released. The stop 376 prevents overt rotation of the door 370 from occurring. Alternatively, the flange 360 can assume a variety of other configurations, and in fact may be entirely upright (i.e., perpendicular relative to ground). Even further, the exterior frame 340 can be adapted to receive and maintain a sliding door assembly. Regardless, access to an interior of the exterior frame 340 is provided via the opening 362.

With specific reference to FIG. 10, the interior container 342 includes a floor 380, a rear panel 382, and a front panel 384. In alternative embodiments, the interior container 342 can include additional sides or panels. Regardless, the rear panel 382 and the front panel 384 combine to define at least a portion of a major opening 386 (opposite the base 380) of an interior region 388 within which product (not shown) is contained.

The exterior frame 340 and the interior container 342 are configured such that upon assembly and with reference to FIG. 10, the rear panel 382 is spaced from the back wall 356 a slight distance to establish an airflow path or plenum 390 along and between the back wall 356 and the rear wall 382. The passageway or supply plenum 390 is fluidly connected to the second channel 368 in the floor 350 of the exterior frame 340. The second channel 368 is, in turn, fluidly connected to an airflow passageway (or transition plenum) 392 established between the exterior frame 340 and the frame 330 of the transition assembly 304. Similarly, a return plenum 394 is established between an exterior of the front panel 384 of the interior container 342 and an interior of the front wall 358 of the exterior frame 340. The return plenum 394 is fluidly connected to the first fan 316 via the first channel 367 and the passage 366. In one embodiment, a grill 396 is assembled to the front panel 384 at an entrance of the return plenum 394 to prevent objects from undesirably entering the return plenum 394 (e.g., the grill 396 captures objects that consumers might otherwise attempt to place (knowingly or unknowingly) in between the exterior frame 340 and the interior container 342).

During use, the thermoelectric assembly 302 operates to cool product (not shown) maintained within the interior container 342. In this regard, the interior container 342 may include shelves (not shown) that provide enhanced display of contained product. The control unit (not shown) controls operation of the thermoelectric device 310 as well as the fans 316-320 as previously described. In general terms, the control unit selectively powers the thermoelectric device 310, causing the cold sink 312 to decrease in temperature while the hot sink 314 increases in temperature. To this end, operation of the second fan 318 delivers ambient air across the hot sink 314, thus elevating the rate at which the cold sink 312 cools. The first fan 316 operates to direct airflow across the cold sink 312, with the cooled air then being forced through the transition plenum 392 and then the supply plenum 390. As shown by arrows A in FIG. 10, cooled air exits the supply plenum 390 at a top of the interior container 342, cascading downwardly (via gravity) onto the contained product (not shown) contained within the interior region 388. Subsequently, the first fan 316 draws air from the interior region 388 (via the return plenum 394, the first channel 367, and the passage 366), and across the cold sink 312, thus establishing a continuous airflow pattern. Finally, condensation collected in a reservoir 398 is evaporated via operation of the third fan 320.

The merchandising units of the present invention provide a marked improvement over previous designs. The thermoelectric device provides long-term, consistent cooling of products, akin to a refrigerator and/or a freezer. However, unlike conventional designs, the thermoelectric device is not located on top of the unit in a manner that will otherwise hinder access to contained products, generate uncontrolled condensation, and negatively impact an aesthetic appeal of the unit (that might otherwise dissuade a consumer from selecting product within the unit). In contrast, the present invention to uniquely locates the thermoelectric device (and other mechanical components) apart from the top, facilitating condensation management, less noise generation at ear level, no blowing fans at ear/eye level, and a large opening for viewing and accessing product. Further, airflow to and from the unit, in one embodiment, occurs at the bottom such that the unit can readily be located against a wall or other display without affecting the unit's cooling capacity.

Although specific embodiments of a portable cooled merchandizing unit have been illustrated and described, it will be appreciated by those of ordinary skill in the art that a variety of alternate and/or equivalent implementations can be substituted for the specific embodiments described without departing from the scope of the present invention. This application is intended to cover any adaptations or variations of portable cooled merchandizing units having a product container assembly and an airflow path configured to direct cooled air into a product display container. Therefore, it is intended that this invention be limited only by the claims and the equivalents thereof.

What is claimed is:

1. A portable cooled merchandizing unit comprising:

a product container assembly including an interior floor to support product and at least one interior panel extending from the floor to define a portion of an interior region, the product container assembly further defining an opening to the interior region opposite the floor and a first airflow path extending along at least a portion of an exterior of the panel and fluidly connected to the opening;

a thermoelectric assembly connected to the product container assembly and including a thermoelectric device, a first heat sink fluidly connected to the first airflow path away from the opening, and a first fan positioned adjacent the first heat sink;

a support surface supporting the first heat sink and separating the first heat sink from a condensate reservoir;

a conduit fluidly connecting the surface and the condensate reservoir to deliver condensation from the first heat sink to the condensate reservoir;

a bottom plate defining an inlet opening and an outlet opening; and a frame assembled to, and extending upwardly from, the bottom plate, the frame integrally forming the condensate reservoir and forming a support conduit fluidly connecting the inlet opening and the thermoelectric assembly, wherein the frame supports the support surface, and wherein the condensate reservoir is affixed relative to the frame and is non-movable relative to the support conduit;

wherein the first fan operates to circulate air from the first heat sink, through the first airflow path, and to the opening.

2. The portable cooled merchandizing unit of claim 1, wherein the product container assembly further defines a second airflow path extending opposite the first airflow path, the second airflow path being fluidly connected to the first fan such that the fan operates to draw airflow from the interior region, through the second airflow path, and to the first heat sink.

3. The portable cooled merchandizing unit of claim 1, further comprising:

a transition assembly disposed between the product container assembly and the thermoelectric assembly, the transition assembly including the support surface.

4. The portable cooled merchandizing unit of claim 3, wherein the transition assembly is insulated and combines with the product container assembly to form a transition plenum communicating with the first airflow path.

5. The portable cooled merchandizing unit of claim 3, further comprising:

wherein the conduit is a J-shaped drain tube extending between the transition assembly and the condensate reservoir.

6. The portable cooled merchandizing unit of claim 5, further comprising:

a condensate reservoir fan positioned adjacent the condensate reservoir.

7. The portable cooled merchandizing unit of claim 1, further comprising a bottom plate defining an air intake opening and an air outlet opening.

8. The portable cooled merchandizing unit of claim 7, further comprising:

an air baffle extending downwardly from the bottom between the air intake and air outlet openings.

9. The portable cooled merchandizing unit of claim 1, the thermoelectric assembly further includes a second fan adjacent a second heat sink positioned opposite the first heat sink, and further wherein the second fan operates to circulate air across the second heat sink.

10. The portable cooled merchandizing unit of claim 1, wherein the product container assembly includes:

an exterior frame defining a first wall face opposite a second wall face; and an interior container defining the first panel opposite a second panel;

wherein the interior container is disposed within the exterior frame such that the first panel is offset from the first face to form the first airflow path as a first plenum and the second panel is offset from the second face to form a second plenum.

11. The portable cooled merchandizing unit of claim 1, further comprising:

a door assembly attached to a top of the product container assembly, the door assembly including a movable door to permit selective access to the interior region.

12. The portable cooled merchandizing unit of claim 1, wherein the thermoelectric device is positioned below the interior floor.

13. The portable cooled merchandizing unit of claim 1, further comprising:

light emitting diodes disposed within the product container assembly.

14. The portable cooled merchandizing unit of claim 9, wherein the unit defines a second airflow path from an air intake opening to an air outlet opening, the second airflow path including the second heat sink and the condensate reservoir.

15. The portable cooled merchandizing unit of claim 1, wherein the floor defines a first major plane and the support surface defines a second major plane, and further wherein the first and second major planes are non-coplanar.

16. The portable cooled merchandizing unit of claim 1, wherein the condensate reservoir includes a floor and defines a reservoir opening opposite the floor, the unit further comprising:

a condensate reservoir fan in close proximity to the condensate reservoir, the condensate reservoir fan positioned to force airflow generated by the condensate reservoir fan directly at the reservoir opening.

* * * * *